US009092926B2

(12) United States Patent
Iwatsuki et al.

(10) Patent No.: US 9,092,926 B2
(45) Date of Patent: Jul. 28, 2015

(54) MEDIUM STORAGE AND ADVANCING APPARATUS

(75) Inventors: Kei Iwatsuki, Gunma (JP); Masashi Kashiwabuchi, Gunma (JP); Michio Suetaka, Saitama (JP); Naoki Hata, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/128,280

(22) PCT Filed: May 11, 2012

(86) PCT No.: PCT/JP2012/062103

§ 371 (c)(1),
(2), (4) Date: Dec. 20, 2013

(87) PCT Pub. No.: WO2013/014993

PCT Pub. Date: Jan. 31, 2013

(65) Prior Publication Data

US 2014/0116839 A1 May 1, 2014

(30) Foreign Application Priority Data

Jul. 25, 2011 (JP) ..... 2011-162419

(51) Int. Cl.

*G07D 11/00* (2006.01)
*B65H 29/00* (2006.01)
*G07F 7/04* (2006.01)

(52) U.S. Cl.

CPC ..... *G07D 11/009* (2013.01); *B65H 29/006* (2013.01); *G07D 11/0006* (2013.01);
(Continued)

(58) Field of Classification Search

CPC ..... G07D 11/0006; G07D 11/0009; G07D 2211/00; G07F 7/04
USPC ..... 194/206, 344; 221/71; 242/528
See application file for complete search history.

(56) References Cited

U.S. PATENT DOCUMENTS 4,585,144 A * 4/1986 Granzow et al. ..... 221/7
5,735,516 A * 4/1998 Gerlier et al. ..... 270/60
(Continued)

FOREIGN PATENT DOCUMENTS

CN 1161512 A 10/1997
CN 1314298 A 9/2001
(Continued)

OTHER PUBLICATIONS

Chinese Office Action issued on Jul. 30, 2014 with English translation.
Russian Official Decision of Grant issued on Aug. 27, 2014 with English translation.

*Primary Examiner* — Mark Beauchaine
(74) *Attorney, Agent, or Firm* — Rabin & Berdo, P.C.

(57) ABSTRACT

An apparatus includes one-side reels rotatably arranged, one-side tapes wound around the one-side reels, a drum arranged to rotate in one direction to wind and store a medium with the medium being laid over the one-side tapes and in an opposite direction to pull out the wound medium, and retainers opposed to the one-side tapes with respect to the medium wound by or pulled out from the drum for abutting against a surface of the medium to hold the medium, the one-side tapes having a tape width shorter than the width of the medium corresponding to the length of the medium in a direction perpendicular to a transfer direction of the medium, the one-side tapes being arranged in parallel and spaced with a spacing shorter than the width of the medium in a direction of the width of the medium to abut against another surface of the medium.

12 Claims, 20 Drawing Sheets

(52) U.S. Cl.
CPC .. *G07D11/0012* (2013.01); *B65H 2301/41912* (2013.01); *G07D 2211/00* (2013.01); *G07F 7/04* (2013.01)

(56) References Cited

U.S. PATENT DOCUMENTS

| | | | | |
|---|---|---|---|---|
| 5,996,993 | A | 12/1999 | Arikawa et al. | |
| 6,371,473 | B1 * | 4/2002 | Saltsov et al. | 271/3.01 |
| 6,565,082 | B2 * | 5/2003 | Sasaki et al. | 271/216 |
| 6,585,098 | B2 | 7/2003 | Satou et al. | |
| 7,367,169 | B2 | 5/2008 | Katsumata | |
| 7,516,601 | B2 | 4/2009 | Horiuchi | |
| 7,871,069 | B2 | 1/2011 | Lee et al. | |
| 8,360,223 | B2 | 1/2013 | Iwatsuki et al. | |
| 8,725,297 | B2 * | 5/2014 | Oishi et al. | 700/275 |
| 2002/0113160 | A1 | 8/2002 | Niioka et al. | |
| 2009/0108115 | A1 | 4/2009 | Iwatsuki | |
| 2009/0184452 | A1 | 7/2009 | Yoo et al. | |
| 2011/0133389 | A1 | 6/2011 | Nemoto | |

FOREIGN PATENT DOCUMENTS

| | | | |
|---|---|---|---|
| CN | 1359843 | A | 7/2002 |
| CN | 101096249 | A | 1/2008 |
| CN | 101847286 | A | 9/2010 |
| CN | 102066220 | A | 5/2011 |
| CN | 102124499 | A | 7/2011 |
| JP | 2004-262457 | A | 9/2004 |
| JP | 2008-123093 | A | 5/2008 |
| JP | 2009-107824 | A | 5/2009 |
| JP | 4954675 | B2 | 3/2012 |
| RU | 2 389 663 | C1 | 5/2010 |

* cited by examiner

MEDIUM STORAGE AND ADVANCING APPARATUS

TECHNICAL FIELD

The present invention relates to a medium storage and advancing apparatus and a medium processor, and more specifically to a medium storage and advancing apparatus for storing and discharging a medium such as bills and also a medium processor for storing and discharging a medium and performing a like processing.

BACKGROUND ART

Medium processors include an automated teller machine for use in banking facilities, by way of example. The automated teller machine allows the customer to, for example, deposit and withdraw cash such as bills or coins according to the content of transactions.

For example, the automated teller machine includes a bill slot for delivering and receiving bills to and from the customer, a discriminator for determining the denominations and authenticity of received bills, a temporary storage for temporarily storing received bills and cash cartridges for storing bills classified according to the denominations of bills. The temporary storage and the cash cartridges can serve as a medium storage and advancing apparatus to store and discharge bills.

In the automated teller machine, when the customer inserts bills into the bill slot for deposit, the inserted bills are discriminated by the discriminator. Bills discriminated as normal are temporarily held by the temporary storage. In contrast, the automated teller machine returns a bill, when determined as one that should not be dealt with, to the customer via the bill slot. Subsequently, after the sum of money deposited is confirmed by the customer, in the automated teller machine the discriminator again determines the denominations of bills held in the temporary storage to store the bills in the respective cash cartridges according to the denominations of the bills.

In the temporary storage disclosed in U.S. Patent Application Publication No. 2009/0108115, bills are carried by a single upper tape wound around an upper reel and a single lower tape wound around a lower reel with the shorter edges of the bills aligned in line.

In the temporary storage thus structured, the upper and lower tapes are being wound around the upper and lower reels, respectively, while the drum rotates in the direction opposite to that in storing bills to thereby discharge the stored bills therefrom. There are temporary storages that include a transport guide member at the position opposed to a movable guide. In such a temporary storage, the transport guide member guides the lower surface of bills to be discharged to pull out the bills toward outside.

As bills are being wound around the drum, the apparent outer diameter of the drum increases. Thus, the transport guide member is disposed spaced apart from the drum such as not to bring the guide member into contact with the drum even when the apparent outer diameter of the drum becomes maximum. In pulling out bills, bills are delivered from the drum to the transport guide member with the lower surface of the bills held by the single lower tape.

Some bills might be torn from their ends during market circulation. When such a bill, after wound around the drum, is intended to be discharged, the bill may not always be transferred with a notch situated directly on the lower tape. For example, the bill might be transferred with the notch oriented with respect to the lower tape toward the width direction perpendicular to the transport direction of bills.

Referring to FIG. 28, it is considered that in a known temporary storage 912 a bill BL partially torn passes through above a space formed between a drum 936 and a transport guide member 938. The temporary storage 912 is adapted to carry a bill BL exclusively by an upper tape 962 and a lower tape 972. Therefore, in the space SP between the drum 936 and the transport guide member 938, no component is provided for guiding the lower surface of the bill. Thus, the bill BL might have its torn edge, outer in the width direction, curled and hanging down therefrom.

In that case, the hanging edge of the bill BL is brought into contact with the transport guide member 938. Only the area outer than the notch then goes warping downward from the transport guide member 938, and in turn the bill BL is stuck at the edge of the notch on the transport guide member 938, which might cause jamming.

Even if the bill BL does not collide with the transport guide member 938, the bill BL may partially come into collision with another component included in the automated teller machine, which might also cause jamming.

SUMMARY OF THE INVENTION

In view of the foregoing problems, it is an object of the present invention to provide a medium storage and advancing apparatus and a medium processor that can prevent jam of media, such as bills, to improve the reliability.

In accordance with the present invention, a medium storage and advancing apparatus includes a plurality of one-side reels rotatably arranged, a plurality of one-side tapes respectively wound around the plurality of one-side reels, a drum rotatably arranged to rotate in one direction to wind and store a medium with the medium being laid over the plurality of one-side tapes and in an opposite direction to pull out the wound medium, and a plurality of retainers respectively opposed to the plurality of one-side tapes with respect to the medium wound by the drum or pulled out from the drum, the retainers abutting against an surface of the medium to hold the medium. The plurality of one-side tapes have a tape width shorter by than a width of the medium corresponding to a length of the medium in a direction perpendicular to a transfer direction of the medium, the plurality of one-side tapes being arranged in parallel and spaced with a spacing shorter than the width of the medium in a direction of the width of the medium to abut against another surface of the medium.

Further in accordance with the present invention, a medium processor includes a medium transport path for transferring a medium, a medium gateway for receiving and advancing the medium from and to the medium transport path, a plurality of one-side reels rotatably arranged, a plurality of one-side tapes respectively wound around the plurality of one-side reels, a drum rotatably arranged to rotate in one direction to wind and store the medium with the medium being laid over the plurality of one-side tapes and in an opposite direction to pull out the wound medium, and a plurality of retainers respectively arranged opposed to the plurality of one-side tapes with respect to the medium wound by the drum and advanced from the drum, the retainers abutting against an surface of the medium to hold the medium. The plurality of one-side tapes have a tape width shorter than a width of the medium corresponding to a length of the medium in a direction perpendicular to a transfer direction of the medium, the plurality of one-side tapes being arranged in parallel and spaced with a spacing shorter than the width of the medium in a direction of the width of the medium to abut against another surface of the medium.

The invention can prevent the tip of a medium, such as bills, from being curled up during the transfer of the medium within the apparatus.

Furthermore, the invention can provide a medium storage and advancing apparatus and a medium processor that can prevent a media from jamming, thus improving the reliability.

BRIEF DESCRIPTION OF THE DRAWINGS

The objects and features of the present invention will become more apparent from consideration of the following detailed description taken in conjunction with the accompanying drawings in which.

BEST MODE FOR IMPLEMENTING THE INVENTION

With reference to the accompanying drawings, a medium processor and a medium storage and advancing apparatus according to preferred embodiments of the present invention will be described in detail. A medium to be processed by such apparatuses has its planer appearance which is rectangular, for example. The embodiment is directed to a medium processor for processing bills as a medium, that is, an automated teller machine 10, which includes a temporary storage 12 arranged therein which serves as a medium storage and advancing apparatus. However, a medium processed by the medium processor is not restricted to bills, but may be any thin sheet- or strip-like media, such as a gift ticket, a cash voucher, an admission ticket, a check, a deed or a railway ticket. Thus, the medium processor is not restricted to the automated teller machine 10 for dealing with bills, of course. The medium storage and advancing apparatus may be any devices that store therein a sheet- or strip-like medium and develop the medium therefrom. Thus, the embodiment of the medium storage and advancing apparatus is not restricted to the temporary storage 12.

Figure 1:
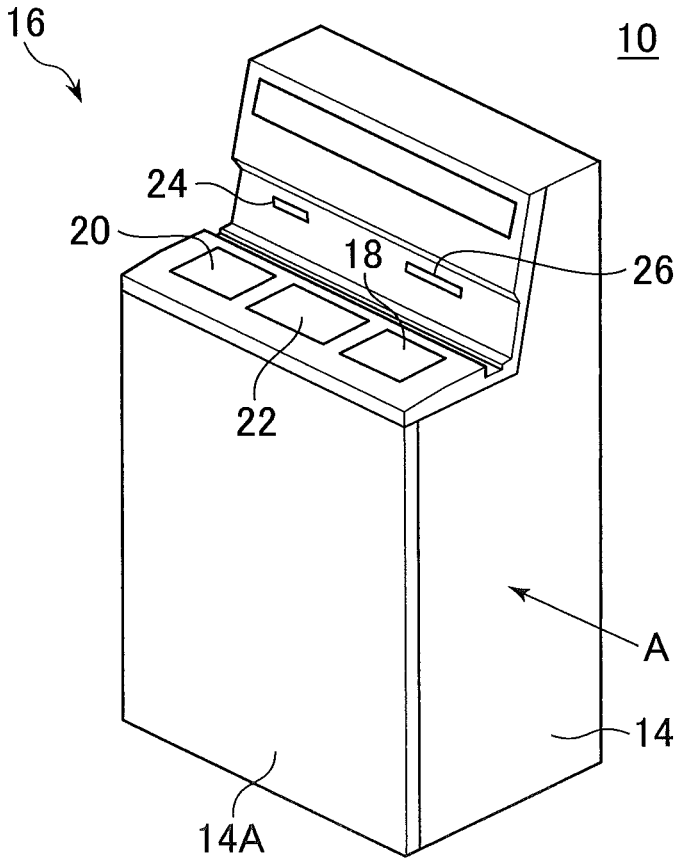
FIG. 1 is a schematic perspective view showing the appearance of an illustrative embodiment of a medium processor according to the present invention.

As seen from an appearance shown in FIG. 1, the automated teller machine 10 in accordance with an embodiment of the medium processor of the invention is accommodated in a box-like housing 14, and conducts transactions on cash with the customer.

The housing 14 is provided with a customer interface 16 on such a position that allows the customer to easily insert bills and operate a touch panel while standing facing a front face 14A of the housing 14, specifically, in the upper part or surface of the front face 14A. The customer interface 16 is adapted to directly receive and deliver cash and a bankbook from and to the customer, notify the customer of information on transactions and accept instructions for operations.

The customer interface 16 includes a bill slot 18 into which bills are inserted by the customer and from which bills are delivered to the customer. The bill slot 18 has a shutter (not shown), which is driven to open and close the bill slot 18.

The customer interface 16 also includes a coin slot 20 into which coins are thrown by the customer and from which coins are delivered to the customer. The customer interface 16 further includes a display and operation section 22 for displaying information on transactions and receiving entries of information on transactions by the customer. The display and operation section 22 is a manipulation unit including a display unit for displaying operational screens for transactions and an input unit for receiving choices of the types of transactions, a passcode, the money amount of transactions and so on, the display unit being integrated with or separated from the input unit.

The customer interface further includes a bankbook slot 24 and a card slot 26. The bankbook slot 24 is a component of receiving a bankbook for transaction and ejecting the bankbook after completion of the transaction. The bankbook slot 24 has in its back a bankbook processor (not shown) for writing the content of transaction or the like on a bankbook. The card slot 26 is for use in receiving various types of cards, such as an ATM card, and ejecting the inserted card. The card slot 26 has in its back a card processor (not shown) for reading, for instance, an account number recorded in a card.

Figure 2:
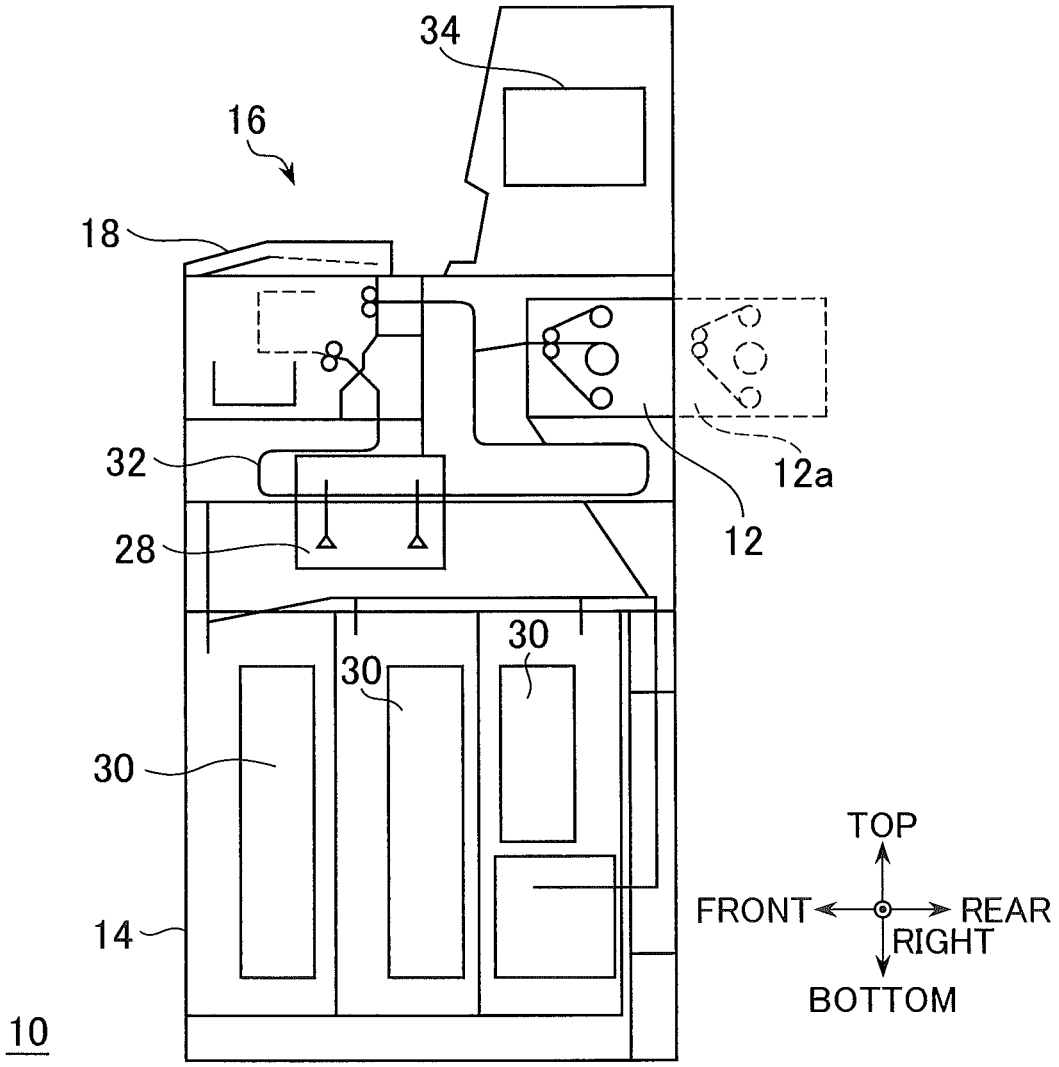
FIG. 2 is a schematic side view showing the internal structure of the embodiment of the medium processor shown in FIG. 1.

FIG. 2 is a side view of the internal structure of the automated teller machine 10 as viewed in the direction of arrow A in FIG. 1, mainly showing a part associated with processing of bills among the internal components of the automated teller machine 10. As shown in the figure, there are arranged the upper part inside the automated teller machine 10 includes the customer interface 16, a discriminator 28 for determining the denominations and authenticity of bills, the temporary storage 12 for temporarily storing deposited bills and so forth. In the lower part of the interior of the automated teller machine 10, there are arranged bill cartridges 30 for storing bills therein classified according to the denominations of bills and the like. Bills are transferred over a transport path 32 between respective processing sections.

The automated teller machine 10 is configured to generally be controlled by a controller 34. When the customer deposits bills for a transaction, the controller 34 accepts a predetermined input for operations on the display and operation section 22 and then opens the shutter of the bill slot 18 to prompt him or her to insert bills. Subsequently, the controller 34 allows inserted bills to be delivered on the transport path 32 to the discriminator 28. The controller 34 causes the discriminator 28 to discriminate the bill and allows the bills discriminated as normal to be delivered to the temporary storage 12, in which the bills are temporarily held. In contrast, the controller 34 makes a bill rejected as a bill that should not be dealt with returned to the customer via the bill slot 18.

Thereafter, the controller 34 prompts the customer to confirm the amount of money deposited on the display and operation section 22 and allows the bills held in the temporary storage 12 to be delivered to the discriminator 28 again. The discriminator 28 determines the denominations of the bills again. The discriminated bills are delivered to and stored in appropriate cassettes in the bill cartridges 30 according to the denominations of the bills discriminated.

At least one arbitrary surface of the front face 14A, the back surface and both side surfaces of the housing 14 has a door, not shown, provided. During cash transactions with the customer, the doors are closed as shown in FIGS. 1 and 2 so that the housing 14 protects bills stored in the cash cartridges 30 and the like. The casing 14 is adapted such that, for maintenance work performed by a service person, the doors can open if necessary. This structure allows the service person to easily access the processing units in the automated teller machine 10.

The automated teller machine 10 may be structured to allow, during maintenance work, the door on the back surface to open and to the temporary storage 12 to be drawn out by means of a sliding mechanism, for example, in the backward direction as represented by a broken line 12*a*. In this case, in the automated teller machine 10, the upper surface of the temporary storage 12 is more preferably structured to be inclinable in the backward direction.

Figure 3:
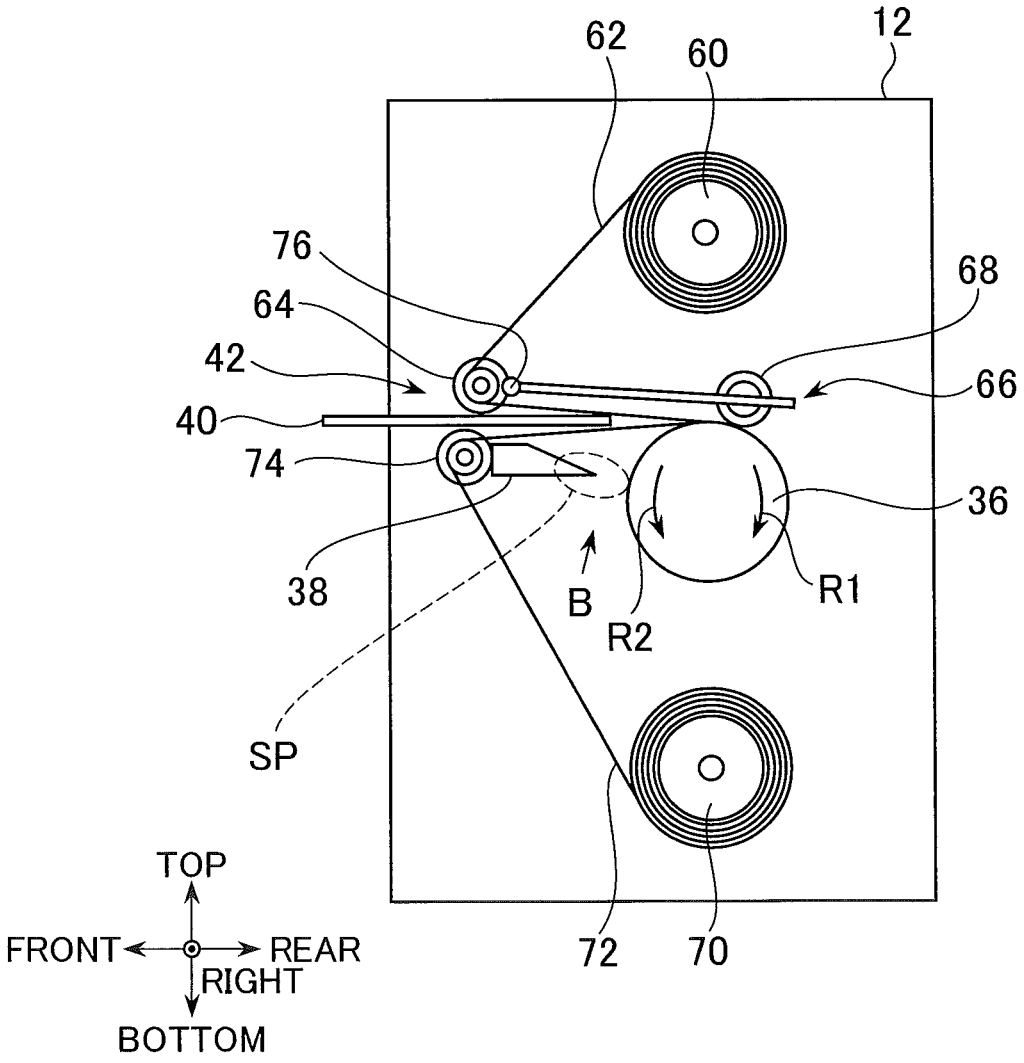
FIG. 3 is a schematic side view showing the structure of an illustrative embodiment of a medium storage and advancing apparatus according to the present invention.
Figure 4:
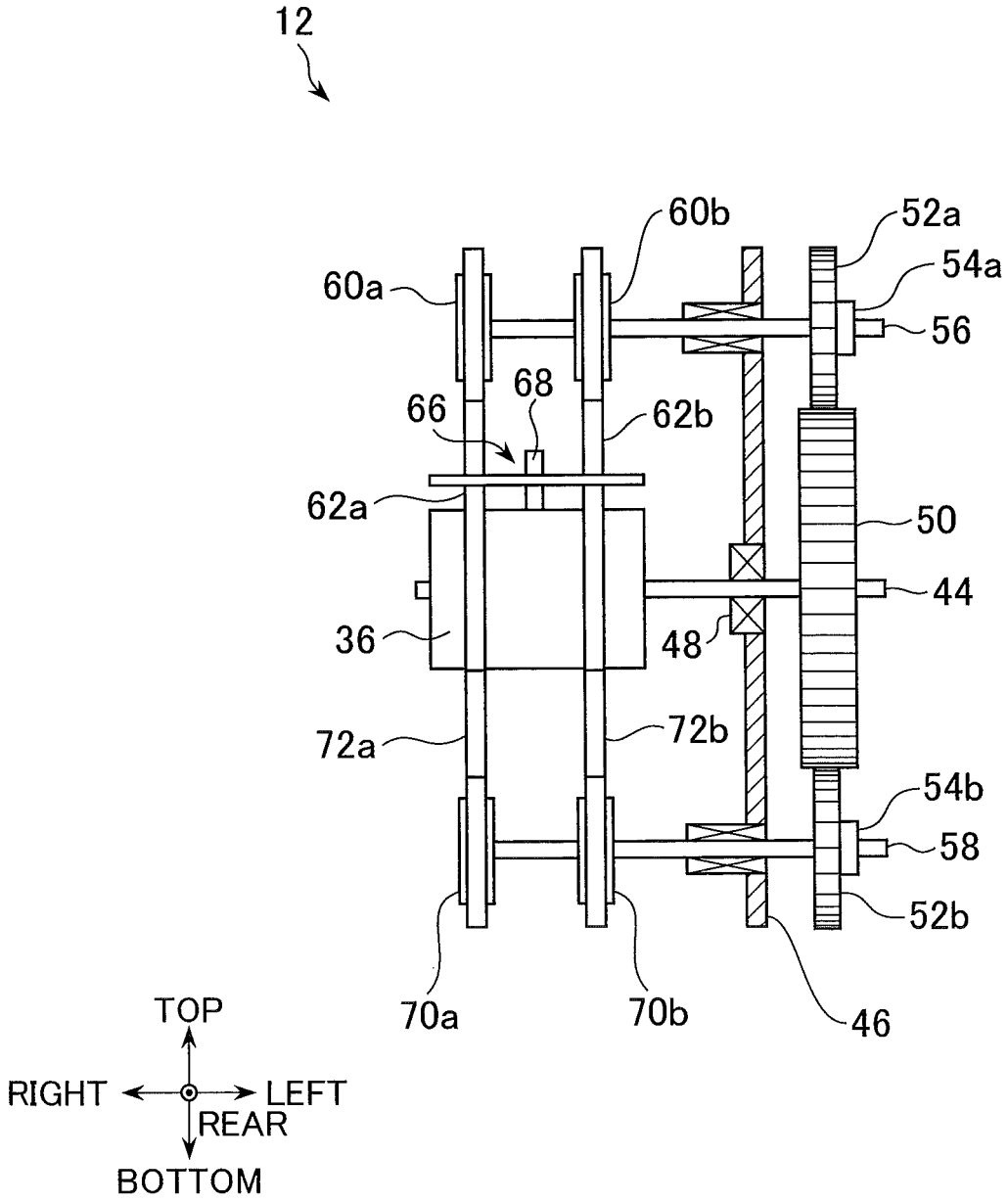
FIG. 4 is a partially cross-sectional back view showing the substantial part of the embodiment shown in FIG. 3, together with a driving mechanism included therein.
Figure 5:
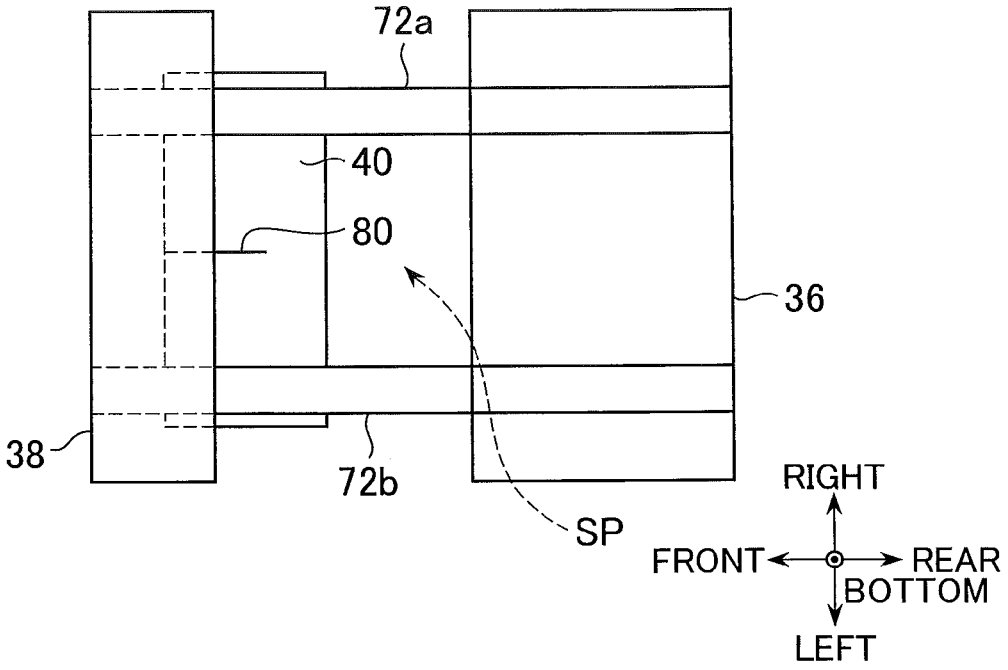
FIG. 5 is a partial bottom view of the substantial part of the embodiment shown in FIG. 3 as viewed upward from a lower reel.

FIGS. 3 to 5 show the temporary storage 12 which is one of the components incorporated in the automated teller machine 10. The temporary storage 12 is an embodiment of the medium storage and advancing apparatus according to the invention. Referring to FIG. 3, the left and the right side of the temporary storage 12 correspond to the front surface 14A and the back surface, respectively, of the automated teller machine 10. FIG. 4 shows a partially cross-sectional back view of the temporary storage 12 as viewed from the back side of the storage 12 shown in FIG. 3, together with a driving mechanism included therein. FIG. 5 shows the temporary storage 12 as viewed in the direction of arrow B in FIG. 3, that is, from below a space SP between a drum 36 and a transport guide 38.

The front surface of the storage 12 has a bill transaction slot 42 arranged to serve as a gateway to the inside of the temporary storage 12 for a bill 40.

The temporary storage 12 includes the drum 36 for temporarily placing thereon a bill 40 received from the bill transaction slot 42. The drum 36 has a drum shaft 44 fixed thereon. The drum shaft 44 rotates by the drive of a driving motor, not shown, and the drum 36 also rotates by the rotation of the drum shaft 44. In the embodiment shown in FIG. 4, the drum shaft 44 is attached to a frame 46 disposed inside the temporary storage 12 by a bearing 48 to extend in the lateral direction of the temporary storage 12. That attachment allows the drum shaft 44 to rotate with respect to the frame 46.

The drum 36 has a cylindrical shape and rotates about the drum shaft 44 in the direction of arrow R1 shown in FIG. 3, thereby causing the bill 40 received from the bill transaction slot 42 to be wound around its cylindrical surface to temporarily store the bill 40. Also, the drum 36 rotates about the drum shaft 44 in the direction of arrow R2 shown in FIG. 3, thereby causing the bill 40 wound around its cylindrical surface to be rewound to be discharged.

The drum shaft 44 has its end, opposite to the end to which the drum 36 is attached, attached to a drum gear 50. Furthermore, the temporary storage 12 includes reel gears 52*a* and 52*b* in engagement with the drum gear 50. The reel gear 52*a* is attached via a one-way clutch 54*a* to *a* reel shaft 56. Likewise, the reel gear 52*b* is attached via a one-way clutch 54*b* to *a* reel shaft 58.

The one-way clutches 54*a* and 54*b* are parts for transferring only a predetermined directional rotation of the reel gears 52*a* and 52*b*, when receiving the rotation force from the drum gear 50 rotating together with the drum shaft 44, to the respective reel shafts 56 and 58. The drum gear 50, the reel gears 52 and the one-way clutches 54 cause the reel shafts 56 and 58 to rotate in cooperation with the drum shaft 44. The reel shafts 56 and 58 are provided in parallel to the drum shaft 44.

It is apparent that an alternative mechanism can be used to rotate the reel shafts 56 and 58 in cooperation with the drum shaft 44.

The reel shaft 56 has its end, opposite to the end to which the reel gear 52*a* is attached, attached to upper reels 60. In this embodiment, the upper reels 60 comprise an upper reel 60*a* attached to the tip of the reel shaft 56 and an upper reel 60*b* attached closer to the center of the reel shaft 56 than the upper reel 60*a*.

The upper reel 60*a* is provided above the drum 36 to rotate about the reel shaft 56. The upper reel 60*a* is fixed to one edge of an upper tape 62*a*. Material of the upper tape 62*a* is, for example, thin-film resin. The upper tape 62*a* has its width in the lateral direction sufficiently shorter than the longer edge of the bill 40. When the upper reel 60*a* rotates in the direction that pulls the fixed end of the upper tape 62*a*, the upper tape 62*a* is gradually wound along the outer periphery of the upper reel 60*a*.

The upper reel 60*b* is provided above the drum 36 and closer to the center of the reel shaft 56 than the upper reel 60*a* to be spaced apart from the upper reel 60*a* by a distance smaller than the bill width which is the widthwise length of the bill 40. With this arrangement, the upper reel 60*b* rotates about the reel shaft 56 in synchronism with the upper reel 60*a*.

The upper reel 60*b* is fixed to one end of the upper tape 62*b*. Material of the upper tape 62*b* may be similar to that of the upper tape 62*a*. In the embodiment, the tape width in the lateral direction of the upper tape 62*b* is the same as the upper tape 62*a*. However, the tape width of the upper tape 62*b* is not necessarily the same as the upper tape 62*a*. When the upper reel 60*b* rotates in the direction that pulls the fixed end of the upper tape 62*b*, the upper tape 62*b* is gradually wound along the outer periphery of the upper reel 60*b*.

In this way, the upper tapes 62*a* and 62*b* are arranged in parallel to each other with a spacing in between kept smaller than the width of the bill 40 in the lateral direction of the storage 12.

The upper reels 60*a* and 60*b* constitute one-side reels arranged on one side as viewed from the drum 36, that is, above the drum 36 in the embodiment. The upper tapes 62*a* and 62*b*, which are respectively wound around the upper reels 60*a* and 60*b* constituting the one-side reels, constitute one-side tapes disposed on the one side viewed from the drum 36, that is, above the dram 36 in the embodiment.

In the vicinity of the bill transaction slot 42 disposed in front of the drum 36 as viewed from the upper reels 60, two upper idle pulleys 64 are arranged in parallel in the lateral direction so as to rotate about the respective rotational shafts arranged in parallel to the drum shaft 44. The upper idle pulleys 64 can be regarded as constituent elements included in the bill transaction slot 42.

The upper tapes 62*a* and 62*b* pulled out of the upper reels 60*a* and 60*b*, respectively, are hung over the outer peripheries of the respective upper idle pulleys 64 positioned forward, as viewed from the reels 60, to be turned backward. The upper tapes 62*a* and 62*b* abut against the drum 36 by a driven roller 68 provided in a movable guide 66 described later. The upper tapes 62*a* and 62*b* have other ends, located ahead of the points abutting against the drum 36, fixed to the drum 36 together.

The reel shaft 58 has its end, opposite to the end to which the reel gear 52*b* is attached, fixed to lower reels 70. In the embodiment, the lower reels 70 comprise a lower reel 70*a* attached to the tip of the reel shaft 58, and a lower reel 70*b* attached closer to the center of the reel shaft 58 than the lower reel 70*a*.

The lower reel 70*a* is provided opposed to the upper reel 60*a* under the drum 36 to rotate about the reel shaft 58.

The lower reel 70*a* is fixed to one end of the lower tape 72*a*. Material of the lower tape 72*a* is, for example, thin-film resin as with the upper tapes 62. The lower tape 72*a* has its width in the lateral direction equal to that of the upper tape 62*a* and sufficiently shorter than the longer edge of the bill 40. However, the tape width of the lower tape 72*a* is not necessarily the same as the upper tape 62*a*. When the lower reel 70*a* rotates in the direction that pulls one end of the fixed tape 72*a*, the lower tape 72*a* is gradually wound along the outer periphery of the lower reel 70*a*.

It can be considered that the lower and upper tapes 72*a* and 62*a* constitute a pair of tapes.

The lower reel 70*b* is provided under the drum 36 and opposed to the upper reel 60*b* while being spaced apart from the lower reel 70*a* with a spacing smaller than the bill width, which is the length of the bill 40 in the width direction. The lower reel 70*b* has its central portion also attached to the reel shaft 58, so that the lower reel 70*b* rotates in synchronism with the lower reel 70*a*.

The lower reel 70*b* is fixed to one end of the lower tape 72*b*. Material of the lower tape 72*b* may be similar to that of the lower tape 72*a*. The tape width in the lateral direction of the lower tape 72*b* is the same as the upper tape 62*a*. However, the tape width of the lower tape 72*b* is not necessarily the same as the upper tape 62*b*. When the lower reel 70*b* rotates in the direction that pulls the fixed end of the lower tape 72*b*, the lower tape 72*b* is gradually wound along the outer periphery of the lower reel 70*b*.

In this way, the lower tapes 72*a* and 72*b* are arranged in parallel to each other with a spacing in between kept smaller than the width of the bill 40 in the lateral direction of the storage 12. The lower tapes 72 are disposed in the temporary storage 12 in this way to be in contact with one surface of bills to be thereby capable of serving as a retainer for holding bills.

It can be considered that the lower and upper tapes 72*b* and 62*b* can constitute a pair of tapes.

The lower reels 70*a* and 70*b* are both arranged to be opposed to the upper reels 60*a* and 60*b* configuring the one-side reels as viewed from the drum 36. With this arrangement, it can be considered that the lower reels 70*a* and 70*b* constitute other-side reels opposed to the one-side reels. Furthermore, the lower tapes 72*a* and 72*b* wound around the respective lower reels 70*a* and 70*b* constituting the other-side reels are opposed to the respective upper tapes 62*a* and 62*b* configuring the one-side tapes. With this arrangement, it can be considered that the lower tapes 72*a* and 72*b* constitute other-side tapes arranged opposed to the one-side tapes.

In the vicinity of the bill transaction slot 42 disposed in front of the drum 36 as viewed from the lower reels 70, two lower idle pulleys 74 are arranged in parallel in the lateral direction so as to rotate about the respective rotational shafts provided in parallel to the drum shaft 44. The lower idle pulleys 74 are disposed under the upper idle pulleys 64. Since the bill 40, when being transferred, passes through the space between the upper idle pulleys 64 and the lower idle pulleys 74, the lower idle pulleys 74 can also be regarded as elements included in the bill transaction slot 42.

The lower tapes 72*a* and 72*b* respectively pulled out of the lower reels 70*a* and 70*b* are hung over the outer peripheries of the respective lower idle pulleys 74 located forward, as viewed from the reels 70, to be turned backward. The lower tapes 72*a* and 72*b* abut against the drum. 36 by the driven roller 68 provided in the movable guide 66 described later. The lower tapes 72*a* and 72*b* have other ends, located ahead of the points abutting against the drum 36, fixed to the vicinity of the right and left ends of the outer periphery of the drum 36, respectively.

Description will be made on the relationship of the fixed position of the upper tapes 62 and the lower tapes 72 relative to the drum 36. The pair of upper and lower tapes 62*a* and 72*a* is fixed to the vicinity of the right end of the drum 36 such that the upper tape 62*a* lies on the outer side of the lower tape 72*a* at the outer periphery of the drum 36 when the drum 36 rotates in the direction of winding the tapes 62 and 72. Likewise, the pair of upper and lower tapes 62*b* and 72*b* is fixed to the vicinity of the left end of the drum 36 such that the upper tape 62*b* lies on the outer side of the lower tape 72*b* at the outer periphery of the drum 36 when the drum 36 rotates in the direction of winding the tapes 62 and 72.

The temporary storage 12 includes the movable guide 66 forming a transport path for the bill 40. The movable guide 66 is formed into a plate-like shape having substantially the same width as the drum 36 in the lateral direction. The movable guide 66 extends from the vicinity of the upper idle pulleys 64 to the upper portion of the drum 36. The movable guide 66 has its front end, in the vicinity of the idle pulleys 64, carrying a rotary shaft 76 extending in parallel to the drum shaft 44. Thus, the movable guide 66 is rotatable about the rotary shaft 76 serving as a fulcrum. The movable guide 66 has its rear end urged downward, that is, toward the drum 36, by an elastic member, not shown.

The driven roller 68 is attached to the vicinity of the rear end of the movable guide 66. The driven roller 68 rotates following the drum 36 rotating and then abuts against the surface of the bill 40 wound around the drum 36.

The lower idle pulleys 74 are provided with a plate-like transport guide 38 opposed to the lower part of the movable guide 66. The transport guide 38 provided for the lower idle pulleys 74 can also be regarded as an element included in the bill transaction slot 42.

The transport guide 38 is shaped longer in the lateral direction than the bill 40 in the width direction. The transport guide 38 guides the bill 40 such that the bill 40, when pulled out from the temporary storage 12, is led between the upper idle pulleys 64 and the lower idle pulleys 74.

In this way, the transport path for a medium is formed in the space between the movable guide 66 and the transport guide 38 over the lower side of the movable guide 66.

Now, as the tapes 62 and 72 and the bills 40 are being wound around the drum 36, the apparent outer diameter of the drum 36 gradually increases which includes the wound tapes 62 and 72 and bill 40. The transport guide 38 is positioned so as not to be in contact with the wound tapes 62 and 72 and bill 40 even when the apparent outer diameter of the drum 36 becomes maximum. That is, between the drum 36 and the transport guide 38, near the lower part of the lower tapes 72 rewound by the drum 36, the space SP exists in which no element is provided for carrying the lower surfaces of the bills 40.

The basic operations of the temporary storage 12 thus structured will be described below. When storing the bill 40, in the temporary storage 12 the drum 36 rotates in the winding direction R1 to wind the upper and lower tapes 62 and 72 on the outer periphery of the drum with the upper tapes 62 lying on the lower tapes 72.

The bill 40 inserted via the bill transaction slot 42 is held by the upper and lower tapes 62 and 72 from above and below to be transferred, and then wound along the outer peripheral surface of the drum 36.

As a number of bills 40 are sequentially wound around the drum, the drum 36 has its apparent outer diameter increased. Correspondingly, the movable guide 66 is gradually raised upward by the drum 36 with the rotary shaft 76 serving as the fulcrum.

Thus, the movable guide 66 can keep the driven roller 68 in contact with the bills 40 wound around the drum 36. Thus, although the bills 40 might be bent in the direction of the longer edge thereof while the drum 36 rotates, the movable guide 66 can guide the bills 40 held by the upper and lower tapes 62 and 72 in such a manner as to push the bills 40 against the outer peripheral surface of the drum 36 while spreading the bills 40 in the direction of the longer edge thereof.

In contrast, when pulling out the bills 40, in the temporary storage 12 the drum 36 rotates in the rewinding direction R2 while, in cooperation with the rotation of the drum 36, the upper reels 60 rotate in the direction opposite to the rotation direction of the drum 36 and the lower reels 70 rotate in the same direction as the rotation direction of the drum 36. This operation allows the upper tapes 62 to be wound around the outer peripheral surface of the upper reels 60 and further the lower tapes 72 to be wound around the outer peripheral surface of the lower reels 70.

Thus, the bills 40 are discharged from the drum 36 to be transferred above the space SP between the upper and lower tapes 62 and 72, and then guided by the transport guide 38 to be pulled out to the outside of the temporary storage 12 from the bill transaction slot 42.

Now, as shown in FIG. 5, the bill 40 is assumed to have a notch 80 approximately in the middle of the widthwise direction to extend backward from the tip of the bill in the transport direction of pulling out the bill.

The upper tape 62*a* and the lower tape 72*a* serve as a pair of tapes to catch the right side of the notch 80 of the bill 40 from above and below. The upper tape 62*b* and the lower tape 72*b* serve as a pair of tapes to catch the left side of the notch 80 of the bill 40 from above and below.

That is, in the temporary storage 12, the bill 40 is supported at its upper and lower surfaces from right and left of the notch 80. Thus, the temporary storage 12 can prevent the bill 40 from partially hanging from the notch 80 when the bill 40 passes above the space SP.

Figure 6:
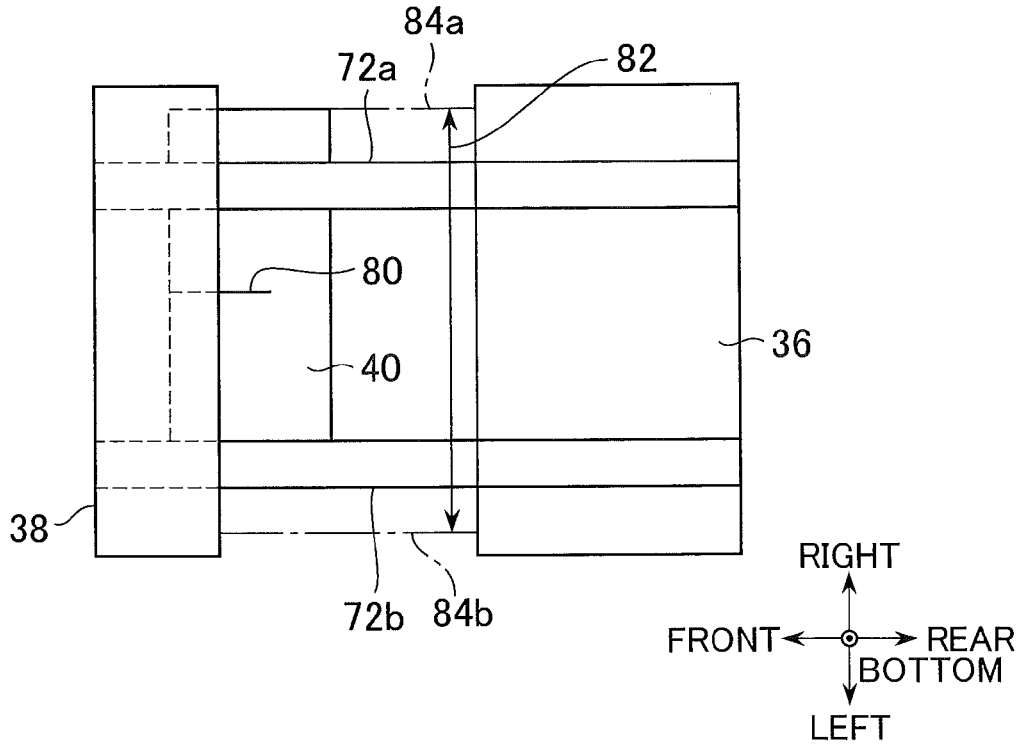
FIG. 6 is a schematic partial bottom view, like FIG. 5, showing the positional relationship between a tape and a notch of a bill in the embodiment shown in FIG. 3.

Well, in the automated teller machine 10 including the temporary storage 12, the transport path on which the bills 40 are transported has its transport width 82 for the bills 40 are set in advance as shown in FIG. 6.

The transport width 82 indicates a distance between a right transport limit line 84*a* and a left transport limit line 84*b*. The right transport limit line 84*a* is the rightmost limitation inside which the bills 40 being conveyed can pass. Likewise, the left transport limit line 84*b* is the leftmost limitation inside which the bills 40 being conveyed can pass.

The bills 40 are physically restricted in position on the transport path, for example, by setting the widthwise length of the bill transaction slot 42 such that the bills 40 do not deviate rightward over the right transport limit line 84*a* and leftward over the left transport limit line 84*b*.

In the automated teller machine 10 and the respective processing units, such as the temporary storage 12, included in the automated teller machine 10, various elements that could interrupt the conveyance of the bills 40 are disposed to avoid a region defined between the right and left transport limit lines 84*a* and 84*b*. The transport width 82 is designed to be larger than the width of the largest ones 40 of the bills to be handled by the automated teller machine 10.

Thus, even if the bill 40 is displaced or skewed in the lateral direction while being conveyed, the automated teller machine 10 can correctly transfer the bill 40 without causing the bill 40 to collide with such elements in the teller machine 10.

The temporary storage 12 in the instant embodiment can prevent the hanging of the bill 40 when having the notch 80 positioning between the right and left edges of the lower tapes 72*a* and 72*b*. That is, when the notch 80 is positioned between the left and right tapes, the temporary storage 12 can prevent the bill 40 from partially hanging down.

However, when the bill 40 has the notch 80 cut on the right or left side with respect to the lower tape 72*a* or 72*b*, respectively, that is, outside the left and right edges of the tapes, a part of the bill outside the notch 80 could not be held by the tapes. As a result, the part of the bill 40 might hang down during transfer.

For this reason, the lower and upper tapes 72*a* and 62*a* provided above the tape 72*a* would preferably be shifted toward as right as possible, and the lower and upper tapes 72*b* and 62*b* located above the tape 72*b* would be shifted toward as left as possible.

However, for example, if the bill 40 is deviated leftward, the right edge of the deviated bill 40 could stay leftward with respect to the left edges of the upper and lower tapes 62*a* and 72*a*. In such a case, the bill 40 could not be held between the upper and lower tapes 62*a* and 72*a*, and would thus be held only between the upper and lower tapes 62*b* and 72*b*. Under the circumstances, like the conventional temporary storage, the bill 40 might be held only by a single pair of upper and lower tapes. Thus, the bill 40 could possibly have its portion, outside the notch 80, warped to collide with the transport guide 38.

In order to avoid this, in the temporary storage 12 of the embodiment, the tapes are arranged to have the width and position thereof such that the tapes catch the bill 40 from both left and right with respect to its notch 80, and two, right and left, pairs of tapes can necessarily hold the bill 40, even when deviating in the lateral direction.

Figure 7:
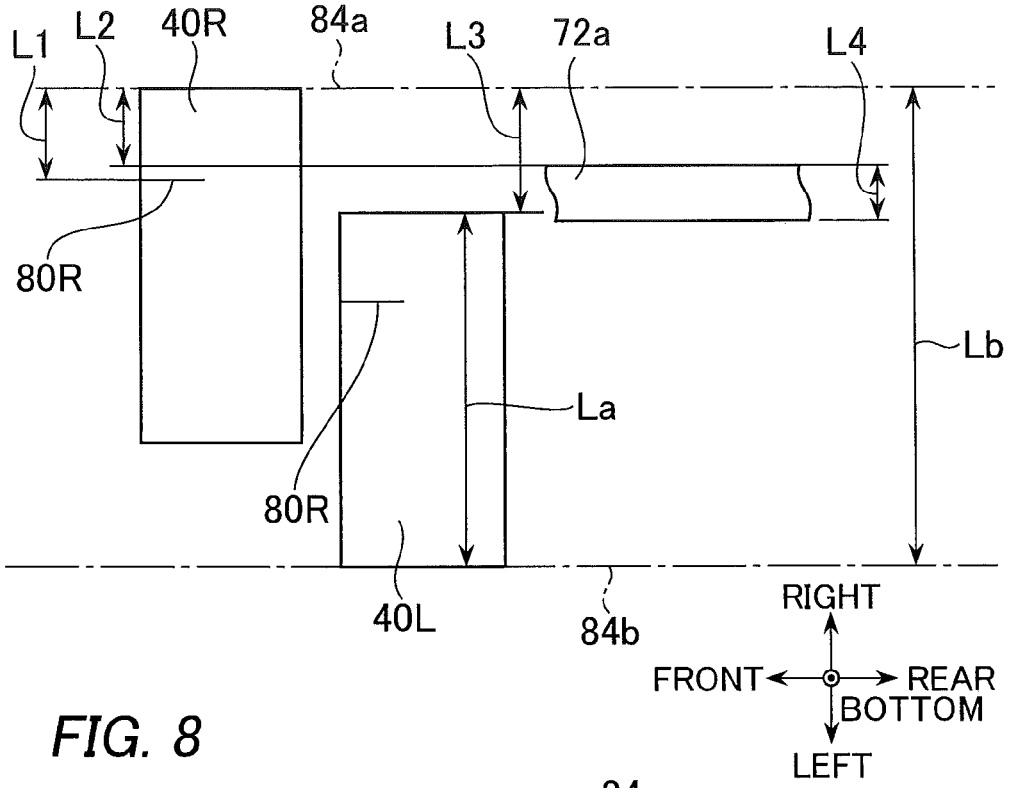
FIGS. 7 and 8 are explanatory bottom views of the substantial part for illustrating conditions for setting the position and width of the tape.

Referring to FIGS. 7 to 13, the conditions on setting the width and position of the tapes will be specifically described. As shown in FIG. 7, a bill having its right edge staying on the right transport limit line 84*a* will be referred to as a bill 40R. A bill having its left end staying on the left transport limit line 84*b* will be referred to as a bill 40L. FIG. 7 omits the lower tape 72*b* from illustration.

The distance from the right transport limit line 84*a* to the assumed position of the notch 80 of the bill 40R is indicated as a distance L1. The distance from the line 84*a* to the right edge of the lower tape 72*a* is indicated as a distance L2. The distance from the line 84*a* to the right edge of the bill 40L is indicated as a distance L3. The width of the lower tape 72*a* is indicated as a length L4. Then, the temporary storage 12 is configured to satisfy following Expression 1.

$$L2<L1 \quad \text{(Expression 1)}$$

Expression 1 defines the condition in which the right edge of the lower tape 72*a* is located right with respect to the notch 80 of the bill 40R. This allows the temporary storage 12 to hold the bill 40, when deviating most rightward as the bill 40R, at the outside of the notch 80 by the lower tape 72*a*.

The temporary storage 12 is configured to satisfy following Expression 2.

$$L2>L3-L4 \quad \text{(Expression 2)}$$

Expression 2 defines that the left edge of the lower tape 72*a* is located left with respect to the right edge of the bill 40L. This allows the temporary storage 12 to hold the bill 40, when deviating most leftward as the bill 40L, by the lower tape 72*a*.

The combination of Expressions 1 and 2 satisfies following Expression 3.

$$L3-L4<L2<L1 \quad \text{(Expression 3)}$$

In the temporary storage 12, the position and width of the lower tape 72*a* are set relative to the position of the bill 40 and the notch 80 to satisfy Expression 3.

Bills 40 may sometimes be dealt with while being bent during circulation in the market, which might put a crease in bills 40. Bills 40, after being repeatedly bent over the same cease, are apt to be broken at the crease. Particularly, bills 40 are often folded at two or four positions in the direction of the longer edge thereof, so that the bills 40 tend to be torn particularly at the central portion thereof in the longitudinal direction or at the positions thereof inner than the opposite edges of the bills in the longitudinal direction by one fourth of the longitudinal length.

The temporary storage 12 in the embodiment of the invention may be designed on the assumption that the bill 40 have an imaginary notch 80R cut leftward from the right edge of the bills 40 by one fourth of the bill width.

The bills 40 may have the central portion in the longitudinal direction thereof also often bent and tend to be broken. In the embodiment, however, even when the bill 40 deviates in the lateral direction, the bill 40 can be normally held at its portions outer than its center in the longitudinal direction by the left and right tapes. Therefore, the above conditions do not take into consideration the possibility of a notch that is likely to be cut in the central portion of the bill 40 in the longitudinal direction but the notch 80R cut at a leftward position apart from the right edge of the bill 40 by one fourth of the bill width.

Now, when the width of the bill 40 and the transport width 82 are indicated as La and Lb, respectively, the distance L1 and L3 are represented by La/4 and Lb−La, respectively. In turn, substitution of the distances L1 and L3 into Expression 3 produces the following Expression 4:

$$Lb-La-L4<L2<La/4 \quad \text{(Expression 4)}$$

In order to handle the notch 80R which is highly likely to exist away from the edge of the bill 40 by one fourth of the bill width in this way, the lower tape 72*a* of the temporary storage 12 is positioned and has its width set so that the bill width La of bills 40 the automated teller machine 10 handles and the transport width Lb satisfy Expression 4.

In general, the automated teller machine 10 handles a variety of bills with different sizes. For bills having the bill width La shorter, the distance L1, for example, La/4 is shorter accordingly, and thus the lower tape 72*a* is preferably disposed as rightward as possible. On the contrary, the bill width La getting shorter renders the distance L3 longer. Thus, if the lower tape 72*a* were disposed excessively rightward, the lower tape 72*a* would fail to even support the bill.

As described above, as the bill width La decreases, it would become more difficult to satisfy Expression 4. It is, however, preferable to set the temporary storage 12 so as to satisfy Expression 4 even for bills that are shortest in the bill width La among a variety of bills to be handled.

With this arrangement, among a variety of bills 40 the temporary storage 12 deals with, any bills, even notched, can be supported by two pairs, left and right, of tapes at both left and right sides of the notch 80R, thereby conveying the bills 40 without partially warping.

Figure 8:
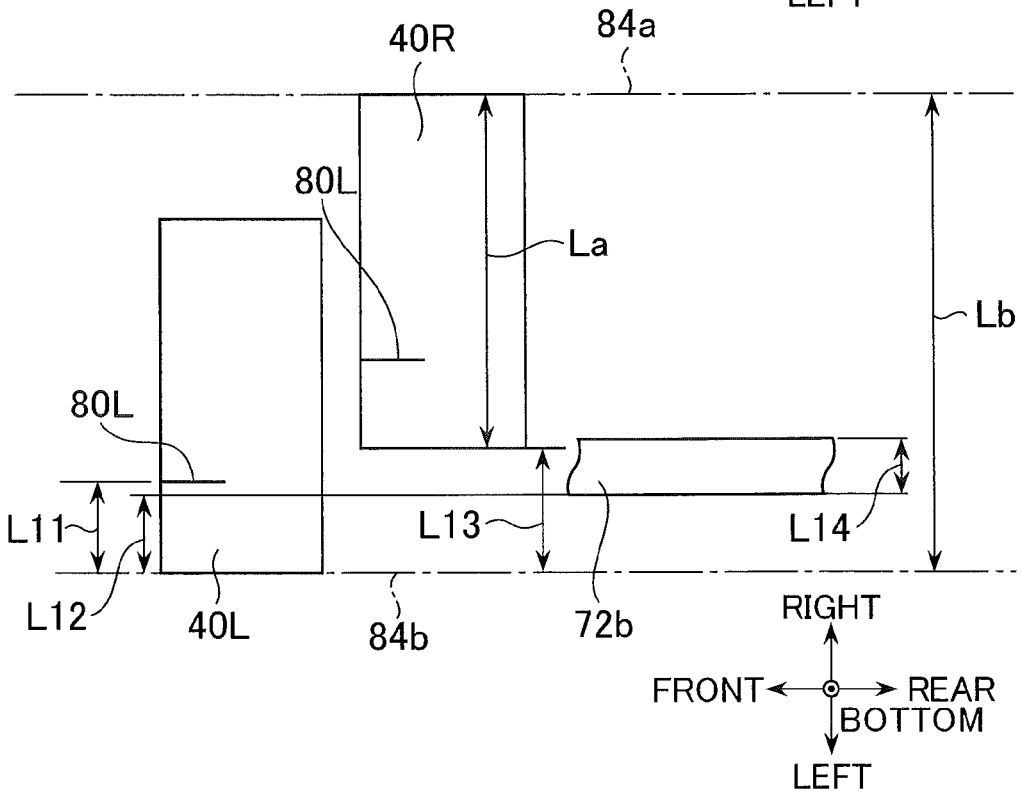

The above description has referred to the relationship in position and width between the lower tape 72*a* and the bill 40 with the notch 80R cut apart from the right edge of the bill 40 by one fourth of the bill width. However, as shown in FIG. 8, the relationship between the lower tape 72*b* and the bill 40 with the notch 80L cut apart from the left edge of the bill 40 by one fourth of the bill width can be set with the above-described relationship reversed in terms of the lateral direction.

More specifically, a distance L11 indicates the distance from the left transport limit line 84*b* to *a* position where the notch 80L of the bill 40 is supposed to be formed. Similarly, distances L12 and L13 indicate the distances from the line 84*b* to *a* left edge of the lower tape 72*b* and to a left edge of the bill 40R, respectively. Furthermore, the tape width of the lower tape 72*b* is indicated by a length L14. Thence, the position and width of the lower tape 72*b* can be set so as to satisfy Expressions 1 to 4 when the earlier-described distances L1, L2 and L3 and the length L4 are substituted by the distances L11, L12 and L13 and the length L14, respectively.

Of course, the invention can be applied not just to the case where the position and width of the tapes are set when the notch is supposed to be formed inward away from the edge of the bill in the direction of the longer edge by one fourth of the bill width. The medium processor and the media storage and advancing apparatus may be structured such as to take account of a position where a notch is highly likely to appear depending on the kinds of media, such as a gift voucher and various tickets, the medium processor and the automated teller machine deal with.

In the temporary storage 12 with the above structure, when the bill 40 is pulled out, the outer peripheries of the upper reels 60*a* and 60*b* rotatably arranged to function as the one-side reels are, respectively, carrying windingly therearound the upper tapes 62*a* and 62*b* functioning as the one-side tapes in abutment with the one surface, i.e. upper surface, of the bill 40. The temporary storage 12 is further arranged so that the outer peripheries of the lower reels 70*a* and 70*b* rotatably arranged to function as the other-side reels are, respectively, carrying windingly therearound the lower tapes 72*a* and 72*b* functioning as the other-side tapes in abutment with the other surface, i.e. lower surface, of the bill 40.

In that operation, the bill 40 is discharged from the drum. 36 to be conveyed between the upper tapes 62 and the lower tapes 72 to pass above the space SP. Further, the bill 40 is guided by the transport guide 38 and pulled out to the outside of the temporary storage 12 via the bill transaction slot 42.

At this time, in the temporary storage 12, the bill 40 is supported from above and below near its right edge by the upper tapes 62*a* and lower tapes 72*a* and near its left edge by the upper tapes 62*b* and lower tapes 72*b*.

Figure 28:
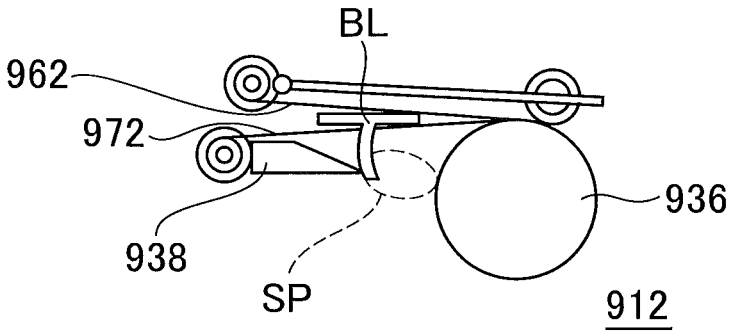
FIG. 28 shows how a medium partially hangs down from a notch in a conventional medium storage and advancing apparatus.

Thus, if the bill 40 in the temporary storage 12 has the notch 80 cut between the right edge of the pair of tapes located right and the left edge of the pair of tapes located left, it can be supported on the left and right sides of the notch 80. The bill would not hang partially, unlike the conventional device 912 shown in FIG. 28.

Figure 9:
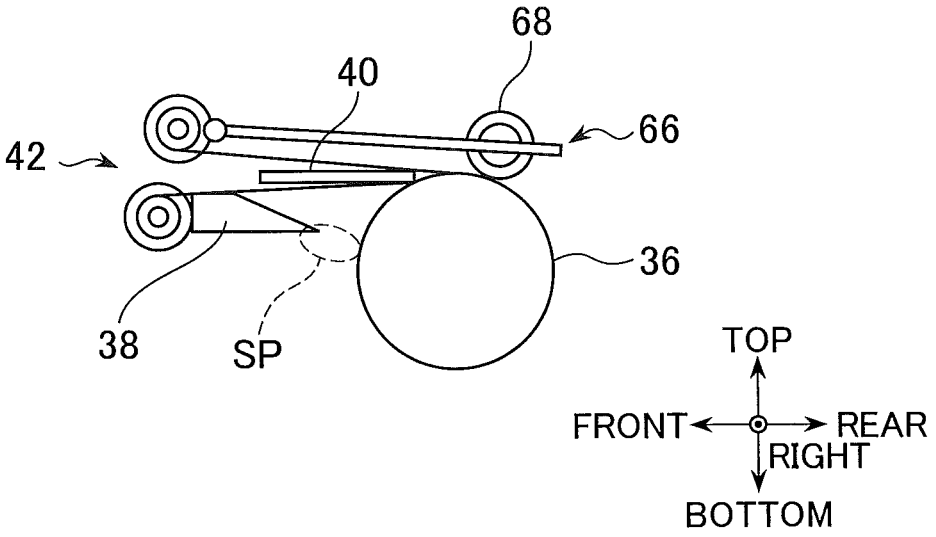
FIG. 9 is a side view showing the substantial part of a medium normally transferred inside the embodiment shown in FIG. 3.

In the temporary storage 12 thus structured, as shown in FIG. 9, the bill 40 can be conveyed in the space SP, while preventing the bill 40 from warping from the notch in the upward or downward direction, to the transport guide 38, thus being pulled out to the outside of the temporary storage 12. In this way, the temporary storage 12 can prevent the bill 40 from colliding with the transport guide 38.

For example, as disclosed in Japanese patent laid-open publication No. 2008-123093, a bill storage and advancing apparatus is proposed which is adapted to support the lower surface of bills by a couple of tapes and the upper surface of the bill by a single tape at a position different from the couple of lower tapes support in the thickness direction of bills. In this apparatus, however, since that apparatus is adapted to support the upper surface of bills 40 only by the single tape, it merely can hold bills 40 to the same extent as the conventional device described earlier.

Figure 29:
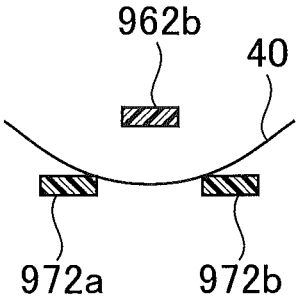
FIG. 29 schematically shows tapes carrying a curled medium in between in the conventional medium storage and advancing apparatus.

The bill 40 may sometimes curl during circulation. In the known device supporting the upper surface of bills by a single tape 962 and the lower surface of the bills by a couple of tapes 972*a* and 972*b*, as shown in FIG. 29, the bill 40 having its central portion warped in the direction of its longer edge (lateral direction in FIG. 29) may not be held by those upper and lower, three, tapes. Thus, the bill 40 may possibly hang from its notch to collide with the transport guide or the like.

Figure 10:
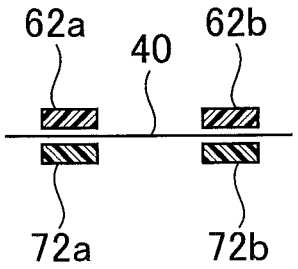
FIGS. 10 and 11 are schematic diagrams showing tapes carrying the medium in between in the embodiment shown in FIG. 3.

In contrast, the temporary storage 12 in accordance with the instant embodiment includes, as shown in FIG. 10, the upper tapes 62*a* and 62*b* arranged alongside on right and left sides and the lower tapes 72*a* and 72*b* respectively arranged to be opposite thereto.

Figure 11:
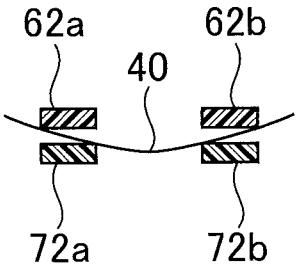

The temporary storage 12 thus structured can, as shown in FIG. 11, catch the curled bill 40 from above and below at its left and right portions. Thus, the temporary storage 12 can suppress the warped central portion of the bill 40 from hanging down. The bill 40 can be prevented from colliding with the transport guide 38.

With the temporary storage 12 of the embodiment thus structured, the bill 40 is supported at the vicinity of its right edge from above and below by the upper tape 62*a* and the lower tape 72*a* and further at the vicinity of its left edge by the upper tape 62*b* and the lower tape 72*b*.

Thus, the temporary storage 12, in which the bill 40 is held at both left and right sides of the notch 80, can prevent the tip of the bill 40 from being curled during conveyance. In this way, the automated teller machine 10 can prevent the bills 40 from jamming, thus improving the reliability.

In some countries, paper notes circulate which have security threads for anticounterfeit. Also in countries where paper bills with security threads have not been issued, being separate from paper bills, business entities will possibly issue and circulate media, such as gift vouchers, having security threads provided for anticounterfeit.

The following will refer to the automated teller machine 10 and the temporary storage 12 adapted for handling bills 140 with a security thread in accordance with an embodiment of the present invention.

Even with the automated teller machine 10 adapted to deal with bills 140 with thread, its essential structure is similar to that of the embodiment shown in FIGS. 1 and 2. Also, the essential structure of the temporary storage 12 is also similar to that shown in FIG. 3.

Figure 12:
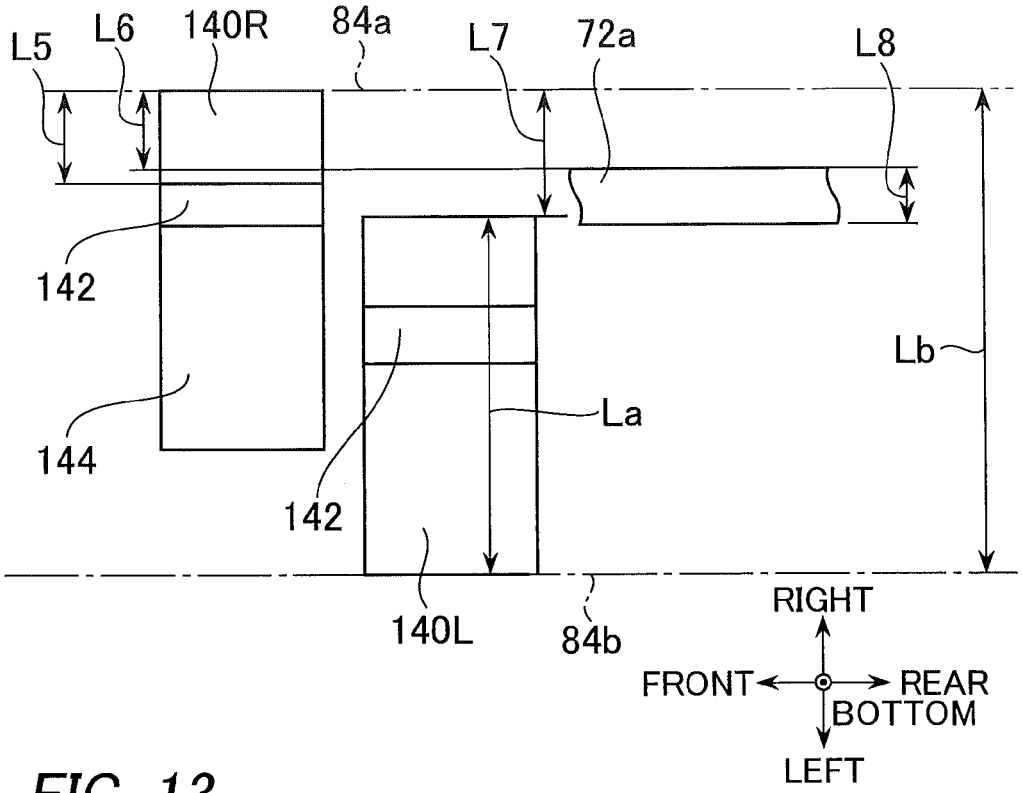
FIGS. 12 and 13 are explanatory bottom views, like FIG. 7, of the substantial part for illustrating conditions for setting the position and width of the tape.

Bills 140 to be handled by the automated teller machine 10 and the temporary storage 12 in accordance with the instant embodiment has, as shown in FIG. 12, a thin strip-like thread 142 for security, which is weaved straight in the bill to extend in the direction of its shorter edge from a position between one end and the other end of the longer edge of the bill.

The thread 142 is made of a material different from a paper part 144 of the bill 140 and, generally, is formed more rigid than the paper part 144. The boundaries between the thread 142 and the paper part 144 tend to be torn because of the difference in material. Thus, a bill 140 notched at such boundaries may partially be curled downward while being transferred.

In the temporary storage 12, the width and position of the tapes are set such that the bill 140 with the thread 144 is held at the boundaries, between the thread 142 and the paper part 144 which tends to be torn, from both left and right sides by the tapes 62 and 72 while the bill 140 can be constantly held by the two pairs of left and right tapes even after the bill 140 deviates in the lateral direction.

The conditions for setting the width and position of the tapes appropriate for the thread will be described below in more detail. As shown in FIG. 12, a bill having its right edge positioned on the right transport limit line 84*a* will be referred to as a bill 140R, and a bill having its left edge positioned on the left transport limit line 84*b* will be referred to as a bill 140L. FIG. 12 omits the lower tape 72*b* from illustration.

In addition, a distance L5 indicates the distance from the right transport limit line 72*a* to *a* position where the right edge of the thread 142 of the bill 140R is assumed to be formed. Similarly, distances L6 and L7 indicate the distances from the line 72*a* to the right edge of the lower tape 72*b* and to the right edge of the bill 140L, respectively. Furthermore, when the tape width of the lower tape 72*a* is indicated as a length L8, the temporary storage 12 is constituted to satisfy following Expression 5.

Note that the thread 142 has its left edge located nearer the center than its right edge. When the portion outside the right edge of the thread 142 can be supported by the lower tape 72*a*, it naturally lead to the portion outside the left edge of the thread 142 can be held also. Thus, the left edge of the thread is excluded from setting the necessary conditions to be set.

$$L6<L5 \quad \text{(Expression 5)}$$

The Expression 5 defines the condition in which the right edge of the lower tape 72*a* extends rightward over the right edge of the thread 142 of the bill 40R. That makes it possible for the temporary storage 12 to hold the bill 140R at its right portion with respect to the thread 142 by the lower tape 72*a* even when the bill 140 deviates most rightward.

The temporary storage 12 is further configured to satisfy following Expression 6.

$$L6>L7-L8 \quad \text{(Expression 6)}$$

Expression 6 defines the condition in which the left edge of the lower tape 72*a* extends leftward over the right edge of the bill 140L. That makes it possible for the temporary storage 12 to hold the bill 140L by the lower tape 72*a* even when the bill 140 deviates most leftward.

The combination of Expressions 5 and 6 leads to following Expression 7.

$$L7-L8<L6<L5 \quad \text{(Expression 7)}$$

In the temporary storage 12, the position and width of the lower tape 72*a* are set such that the position of the bill 140 and the thread 142 satisfy Expression 7.

In general, the automated teller machine 10 handles various sizes of paper bills. Among such bills, even for bills having the width La shortest, it is preferable to set the relationships between the distances and the length in the temporary storage 12 so as to satisfy Expression 7.

Depending on the kinds of bills, the thread 142 may variously be positioned in the direction of the longer edge thereof. When the distance between the right edge of the bill 140 and the right edge of the thread 142 is shorter, the distance L5 is shorter accordingly, and it is thus necessary to position the lower tape 72*a* as rightward as possible. However, if the lower tape 72*a* is located excessively rightward, the lower tape 72*a* would fail to even carry the bill.

The temporary storage 12 is in turn configured to satisfy Expression 7 even for the bill 140 having the thread 142 located closest to its outer edge among various kinds of bills to be handled.

Figure 13:
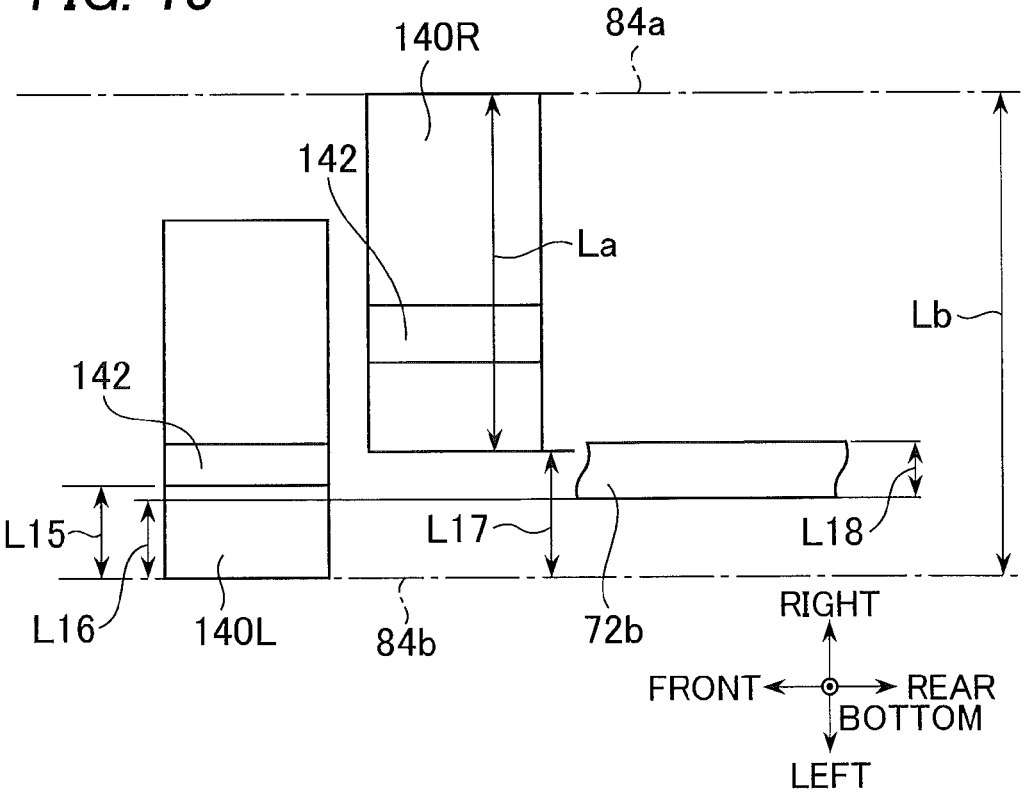

The above description has referred to the thread 142 placed near the right edge of the bill 140. On the contrary, as shown in FIG. 13, when the thread 142 is provided near the left edge of the bill 140, the temporary storage 12 may be configured with the orientation in the above description reversed between right and left.

More specifically, a distance L15 indicates the distance from the left transport limit line 84*b* to the left edge of the thread 142 of the bill 140L. Distances L16 and L17 indicate the distances from the line 84*b* to the left edge of the lower tape 72*b* and to the left edge of the bill 140R, respectively. Further, the tape width of the lower tape 72*b* is indicated as a length L18. Then, it is possible to satisfy Expressions 5 to 7, of which the distances L5, L6 and L7 and the length L8 described earlier are substituted by the distances L15, L16 and L17 and the length L18, respectively.

With the temporary storage 12 thus arranged in accordance with the embodiment of the invention, the bill 140 with the thread 142 is constantly held by means of the two pairs of left and right tapes and the tapes hold both sides of the boundaries between the paper part 144 and the thread 142 formed in the bill 140, which might be torn. Thus, the bill can be conveyed without partially being warped.

The embodiments described so far deal with the bill 140 having a breakable part supposed to be the boundaries between the paper part 144 and the thread 142, by way of example. The idea of the present invention can be applied not only to media threaded but any media having a boundary between elements made of different materials. For example, train tickets or the like, when punched at the edge thereof likely to be easily broken, may be dealt with similarly to the boundary in a medium.

Figure 14:
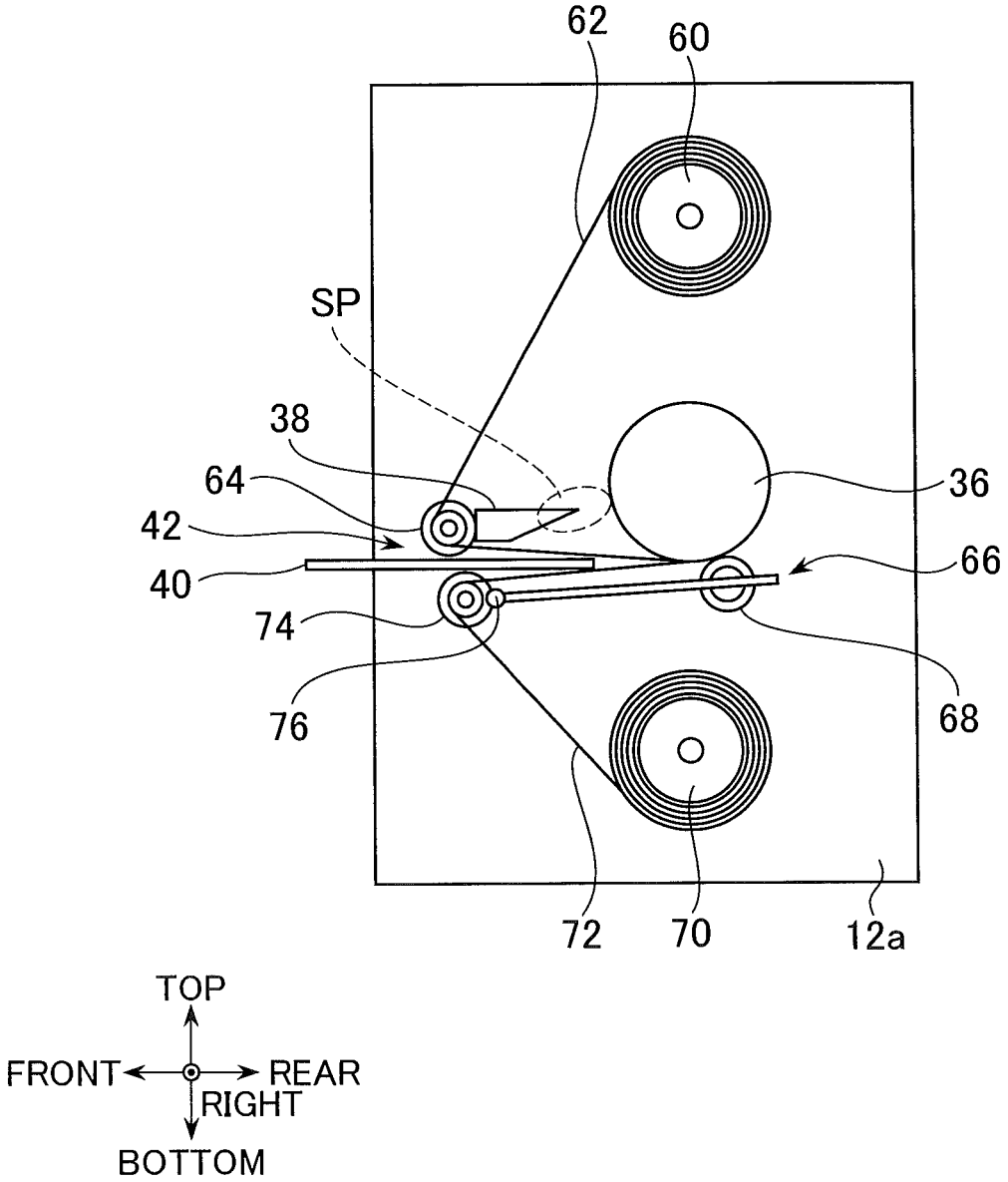
FIG. 14 is a schematic side view showing the structure of a modified embodiment of the medium storage and advancing apparatus shown in FIG. 3.
Figure 15:
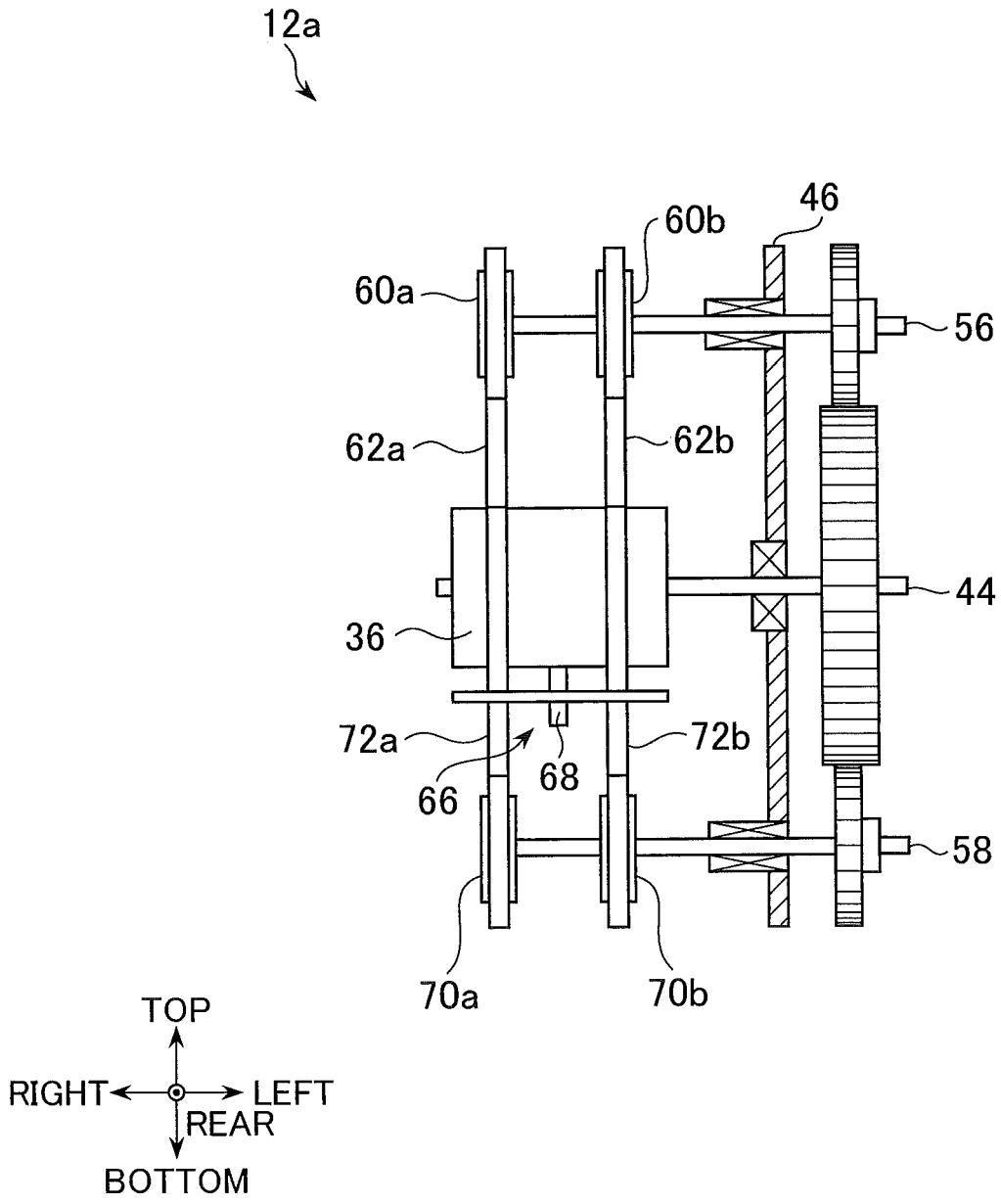
FIG. 15 is a partially cross-sectional back view of the substantial part of the modified embodiment shown in FIG. 14, together with a driving mechanism included therein.

Well, the above description has referred to the embodiments in which, as shown in FIG. 3, the movable guide 66 is disposed above the bill 40 under transportation and the transport guide 38 is disposed below the bill. However, the present invention is not restricted to those embodiments. As with a temporary storage 12*a* shown in FIGS. 14 and 15, the movable guide 66 and the transport guide 38 may, respectively, be disposed under and above the bill 40 under transfer.

The temporary storage 12*a* with the above structure is adapted to support the bill 40 at its lower surface by the movable guide 66, which can prevent the tip of the bill 40 in the transfer direction from hanging down even when the bill 40 is torn. In this embodiment, the temporary storage 12*a* has the two pairs of tapes holding both left and right edges of the bill 40 and thus the bill 40 can be suppressed from warping upward due to the momentum generated upon pulling out the bill 40. Hence, the bill 40 can be prevented from colliding with the transport guide 38 when passing the space SP.

Subsequently, with reference to FIGS. 16 to 18, the structure of a temporary storage 212 will be described in detail, which is an alternative embodiment of the media storage and advancing apparatus in accordance with the invention. The components similar to those of the temporary storage 12 are indicated by the same reference numerals, and will not repetitively be described in detail to avoid a redundant description. The structure of the automated teller machine 10 with the temporary storage 212 is similar to that of the previous embodiments except for the temporary storage 212 included instead of the temporary storage 12. Thus, the detailed repeated description thereof will be refrained from.

Figure 16:
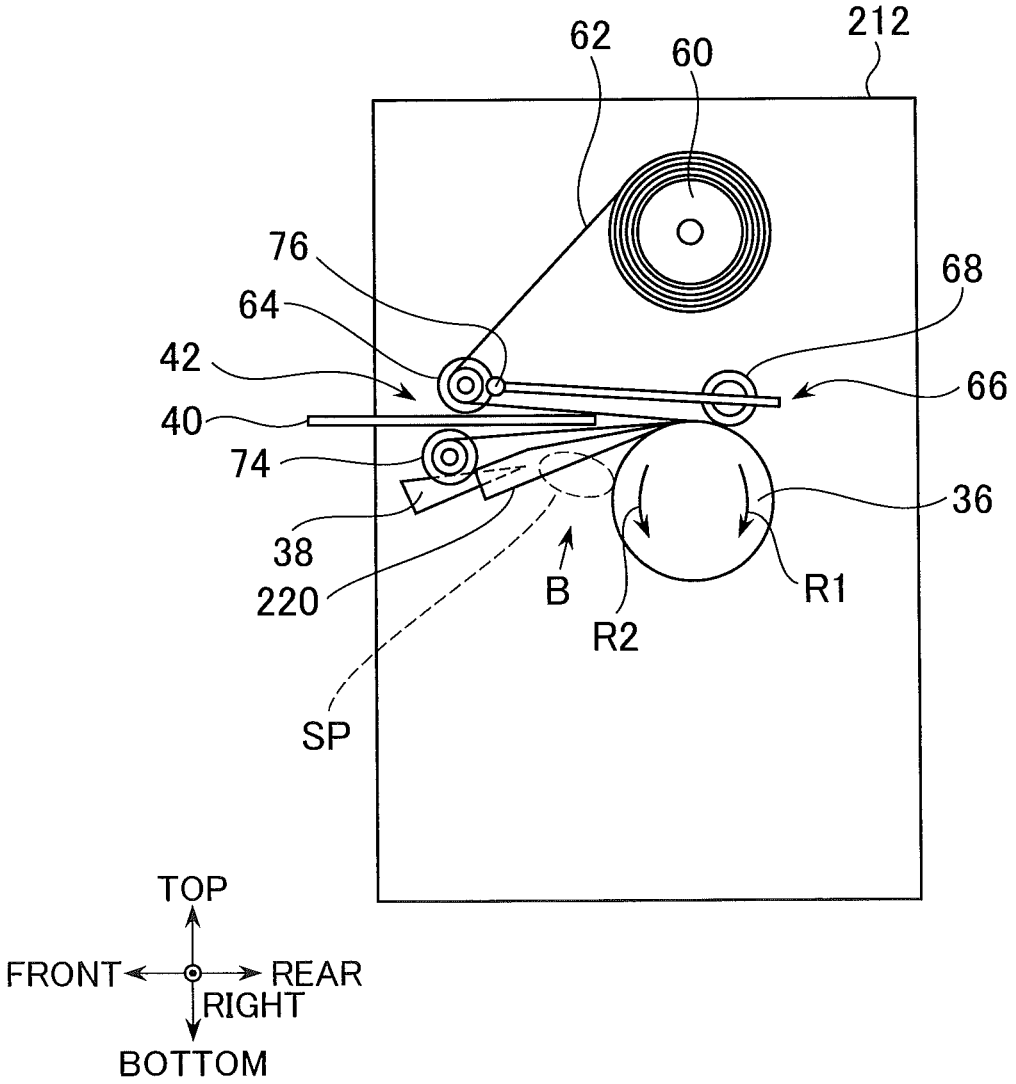
FIG. 16 is a schematic side view, like FIG. 3, showing the structure of an alternative embodiment of the medium storage and advancing apparatus according to the present invention.
Figure 17:
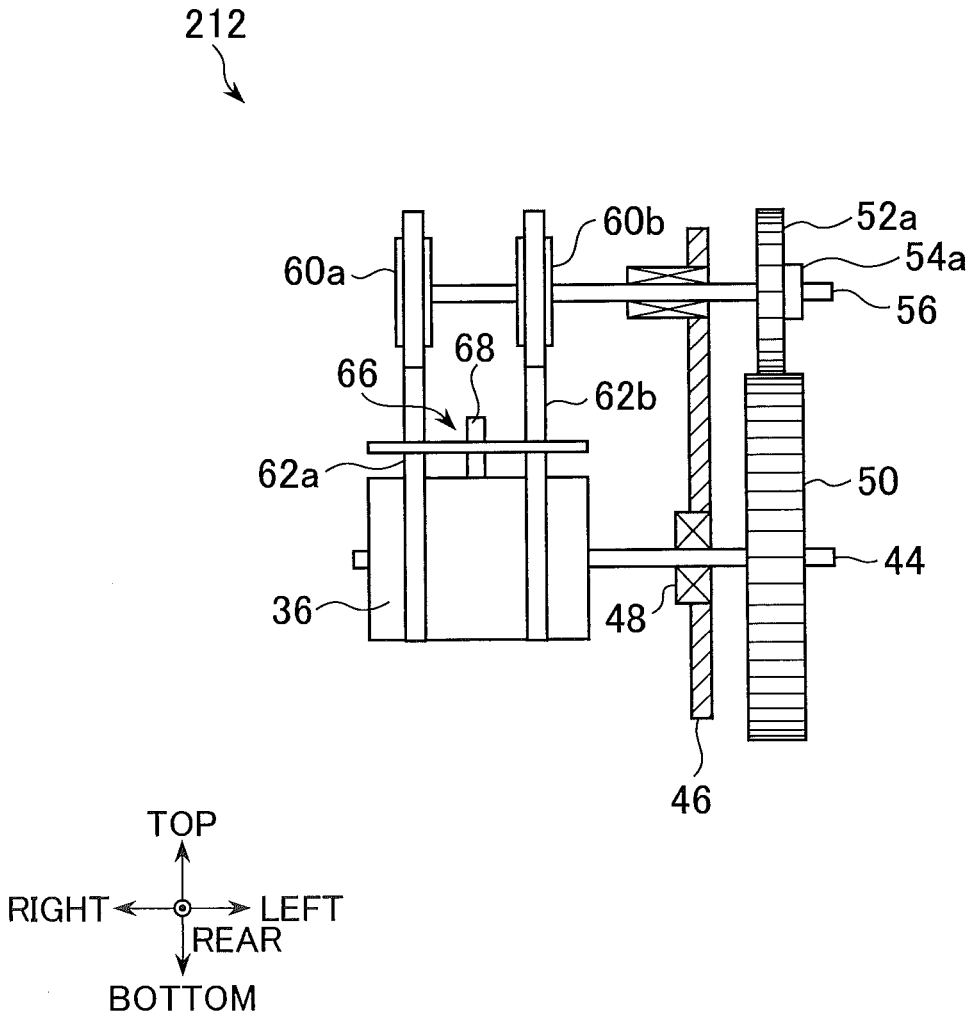
FIG. 17 is a partially cross-sectional back view, like FIG. 4, of the substantial part of the embodiment shown in FIG. 16, together with a driving mechanism included therein.
Figure 18:
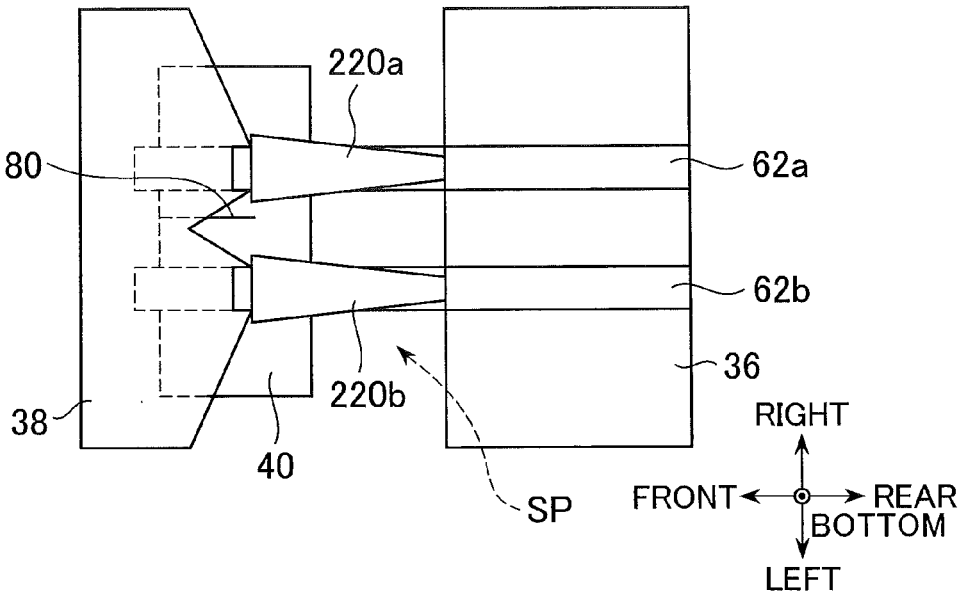
FIG. 18 is a bottom view of the substantial part of the embodiment shown in FIG. 16.

The structure of the temporary storage 212 is shown in FIG. 16, in FIG. 17 that is a back view of the temporary storage 212 as viewed from the back side, and in FIG. 18 that corresponds to FIG. 16 viewed in the direction of arrow B, i.e. from under the space SP. As shown in those figures, the temporary storage 212 is the same as the temporary storage 12 except for scrapers 220 provided instead of the lower reels 70 and the lower tapes 72.

The scrapers 220 comprise a scraper 220*a* arranged opposed to and under the upper tape 62*a* to support the bill 40 in between, and a scraper 220*b* arranged opposed to and under the upper tape 62*b* to support the bill 40 in between.

More specifically, the scrapers 220*a* and 220*b* are disposed under the upper tapes 62*a* and 62*b*, respectively, and spaced apart from each other by the same distance as between the upper tape 62*a* and the upper tape 62*b*. The scrapers 220*a* and 220*b* are to be arranged in parallel and spaced with a spacing smaller than the width of the bill 40 in the lateral direction of the temporary storage 212. Thus, the scrapers 220*a* and 220*b* can serve as retainers being in contact with one surface of the bills 40 to hold the bills 40.

The scrapers 220*a* and 220*b* are independently provided to be rotatable in opposite directions with a rotary shaft of the lower idle pulley 74 as an axis.

The scrapers 220*a* and 220*b* both extend to the drum 36 and have the rear end thereof urged downward, that is, toward the drum 36, by an elastic member, not shown.

In the embodiment, each of the scrapers 220*a* and 220*b* has its width in the lateral direction decreased from its front end toward its rear end, so that the rear end thereof abutting with the upper tapes 62 wound around the drum 36 forms a part minimum in width that is narrowest in width. The width of the rear end of the scrapers 220*a* and 220*b* is configured to be shorter than the width of the upper tapes 62*a* and 62*b*.

With this arrangement, the rear ends of the scrapers 220*a* and 220*b* are constantly in contact with the outer peripheries of the respective upper tapes 62*a* and 62*b* wound around the drum 36.

Furthermore, with the temporary storage 212 thus structured, rotation of the drum 36 in the winding direction R1 when storing the bill 40 causes the upper tapes 62 to be wound along the outer periphery of the drum.

While the upper tapes 62 on the drum 36 are being wound, the bill 40 inserted via the bill transaction slot 42 is wound on the outer periphery of the drum 36 with its outer periphery pressed from the periphery by the upper tapes 62.

As the bills 40 are sequentially wound, the drum 36 increases its apparent outer diameter, so that the movable guide 66 is gradually raised upward with the rotary shaft 76 serving as a fulcrum. Thus, the movable guide 66 makes the driven roller 68 constantly abut against the drum 36 to urge the bills 40 pressed by the upper tape 62 against the outer periphery of the drum 36 for guiding the bills.

In contrast, when pulling out the bill 40 from the temporary storage 212, the drum 36 rotates in the rewinding direction R2 and simultaneously, in cooperation with the drum 36 rotating, the upper reels 60 rotates in the direction opposite to the rotational direction of the drum 36. The rotation of the upper reels 60 causes the upper tapes 62 to be wound along the outer periphery of the upper reels 60.

This operation allows the bill 40 pushed against the drum 36 by the upper tapes 62 to be peeled off by the scrapers 220. The bill 40 peeled off by the scrapers 220 is guided by the transport guide 38 through above the space SP and is then pulled out to the outside of the temporary storage 212 from the bill transaction slot 42.

Now, as shown in FIG. 18, a notch 80 extending backward from the tip of the bill 40 is assumed to exist approximately at the central portion of the bill 40 in the direction of the longer edge of the bill.

When the scrapers 220*a* and 220*b* are positioned on the right and left sides of the notch 80 on the lower surface of the bill 40, the bill 40 can be held from below so that part of the bill 40 does not hung down from the notch 80.

The temporary storage 212 in the instant embodiment can prevent the bill 40 from hanging down when the bill 40 has the notch 80 between the right edge of a part of the scraper 220*a* that is minimum in width and the left edge of a part of the scraper 220*b* that is minimum in width, that is, when the scrapers 220 are positioned on the left and right sides of the notch 80.

However, when the bill 40 has the notch 80 positioned rightward with respect to the part minimum in width of the scraper 220*a* or leftward with respect to the part minimum in width of the scraper 220*b*, apart of the bill outside the notch 80 would not be held by the scraper 220 to possibly hang down.

In preparation against the above situation, it could be proposed to position the scraper 220*a* as rightward as possible and the scraper 220*b* as leftward as possible. In that case, however, for example, when the bill 40 deviates leftward, the right edge of the bill 40 might extend leftward beyond the left edge of the part minimum in width of the scraper 220*a*. The bill 40 would not be held by the scraper 220*a* but only by the scraper 220*b*.

In that state, the bill might have its upper surface held only by the one tape 62*b* and its lower surface held only by the one scraper 220*b*, which might cause the bill 40 to be warped from the notch 80 so as to collide with the transport guide 38.

In the temporary storage 212 in accordance with the embodiment, however, the width of the part minimum in width of the scrapers 220 (which may hereinafter be referred to as a scraper width) and the position of the scrapers are set such that the bill 40 is held by the scrapers 220 on both left and right sides of the notch 80 from below so that the bill 40 can be constantly held by two, left and right, scrapers 220 even when the bill 40 deviates in the lateral direction.

Figure 19:
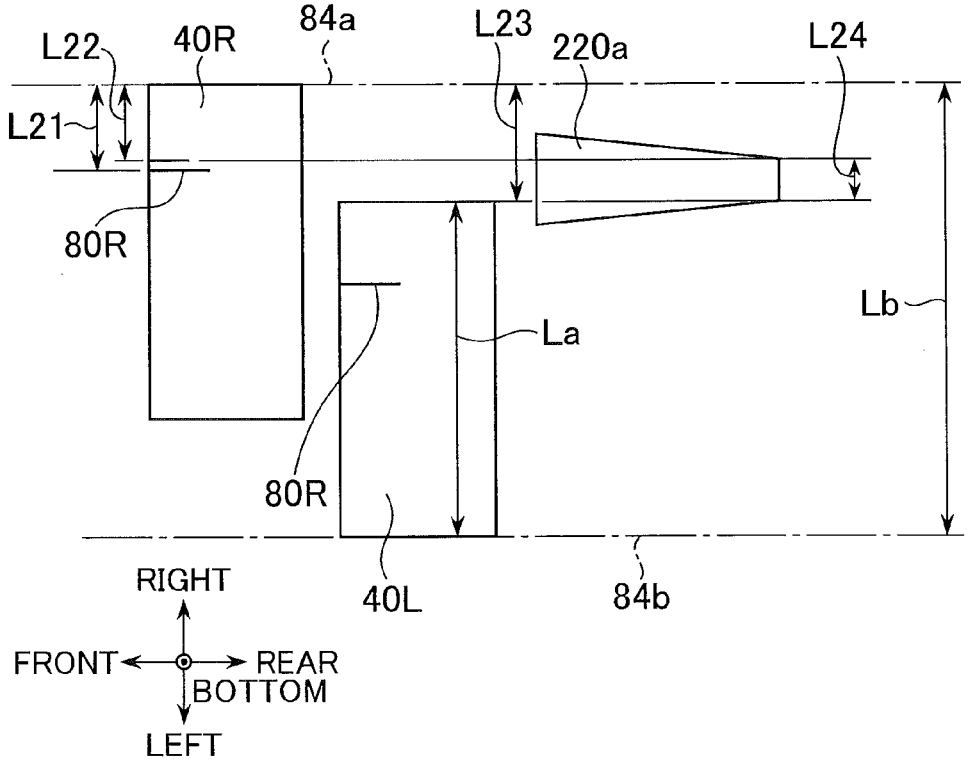
FIGS. 19 through 22 are explanatory bottom views, like FIG. 7, of the substantial part for illustrating conditions for setting the position and width of a scraper.

With reference to FIGS. 19 to 22, the conditions for setting the width and position of the scrapers will be specifically described below. As shown in FIG. 19, the distance from the right transport limit line 84*a* to the position of the notch 80R of the bill 40R is indicated as a distance L21. The distance from the line 84*a* to the right edge of the part minimum in width of the scraper 220*a* is indicated as a distance L22. The distance from the line 84*a* to the right edge of the bill 40L is indicated as a distance L23. Moreover, the width of the scraper 220*a* is indicated as a length L24. Under those conditions, the temporary storage 212 is constituted so as to satisfy following Expression 8. FIG. 19 will omit the scraper 220*b* from illustration.

$$L22<L21 \quad \text{(Expression 8)}$$

Expression 8 defines the condition in which the right edge of the part minimum in width of the scraper 220*a* is located rightward with respect to the notch 80R of the bill 40R. When the above condition is satisfied, in the temporary storage 212, the scraper 220*a* can hold the bill 40R at a portion outer than the notch 80R even when the bill 40 deviates most rightward.

The temporary storage 212 is also configured to satisfy following Expression 9.

$$L22>L23-L24 \quad \text{(Expression 9)}$$

Expression 9 defines the condition in which the left edge of the part minimum in width of the scraper 220*a* is located leftward with respect to the right edge of the bill 40L. When above Expression 9 is satisfied, in the temporary storage 212, the bill 40L can be held by the scraper 220*a* even when the bill 40 deviates most leftward.

The combination of Expressions 8 and 9 leads to following Expression 10. That is, in the temporary storage 212, the position and width of the scraper 220*a* are set so that the positions of the bill 40 and the notch 80 satisfy following Expression 10.

$$L23-L24<L22<L21 \quad \text{(Expression 10)}$$

As described earlier, bills 40 may often be folded at two or four positions in the direction of the longer edge thereof, so that the bills 40 tend to be torn particularly at the central position or at the positions thereof inner than the opposite edges of the bills 40 in the longitudinal direction by one fourth of the longitudinal length. The temporary storage 212 may be configured such as to be adaptable to the above-described notch 80 being cut leftward by one fourth of the bill width from the right edge of the bills 40.

The central portion of the bills 40 in the longitudinal direction also tend to be torn. However, even when the bill 40 deviates leftward or rightward, the central portion of the bill 40 can normally be held by the scrapers at the outer sides of the notch. The above conditions are therefore defined on the assumption that the notch 80 is positioned leftward by one fourth of the bill width from the right edge of the bill 40.

Now, when the bill width of the bill 40 and the transport width 82 are indicated as a length La and a length Lb, respectively, distances L21 and L23 are represented by La/4 and Lb−La, respectively. Substitution of those distances L21 and L23 into Expression 10 leads to following Expression 11.

$$Lb-La-L24<L22<La/4 \quad \text{(Expression 11)}$$

In order to handle the notch 80R which is highly likely to exist away from the edge of the bill by one fourth of the width of the bill in this way, the scraper 220*a* of the temporary storage 212 has its position and width set such that the bill width La and the transport width Lb of bills 40 the automated teller machine 10 handles satisfy Expression 11.

In general, the automated teller machine 10 handles a variety of bills with different sizes. For bills whose bill width La is shorter, the distance L21, e.g. La/4, is shorter accordingly, and thus the scraper 220*a* is preferably disposed as rightward as possible. On the contrary, the bill width La getting shorter renders the distance L23 longer. Thus, if the scraper 220*a* were disposed excessively rightward, the scraper 220*a* would fail to even support the bill.

In this way, as the bill width La is decreased, it would become more difficult to satisfy Expression 11. It is, however, preferable to set the temporary storage 212 so as to satisfy Expression 11 even for the bills 40 that have the shortest width La among a variety of bills to be handled.

With this arrangement, among a variety of bills the temporary storage 212 deals with, any bills, even notched, can be supported by left and right scrapers 220 at both left and right sides of the notch, thereby conveying the bills without partially warping.

Figure 20:
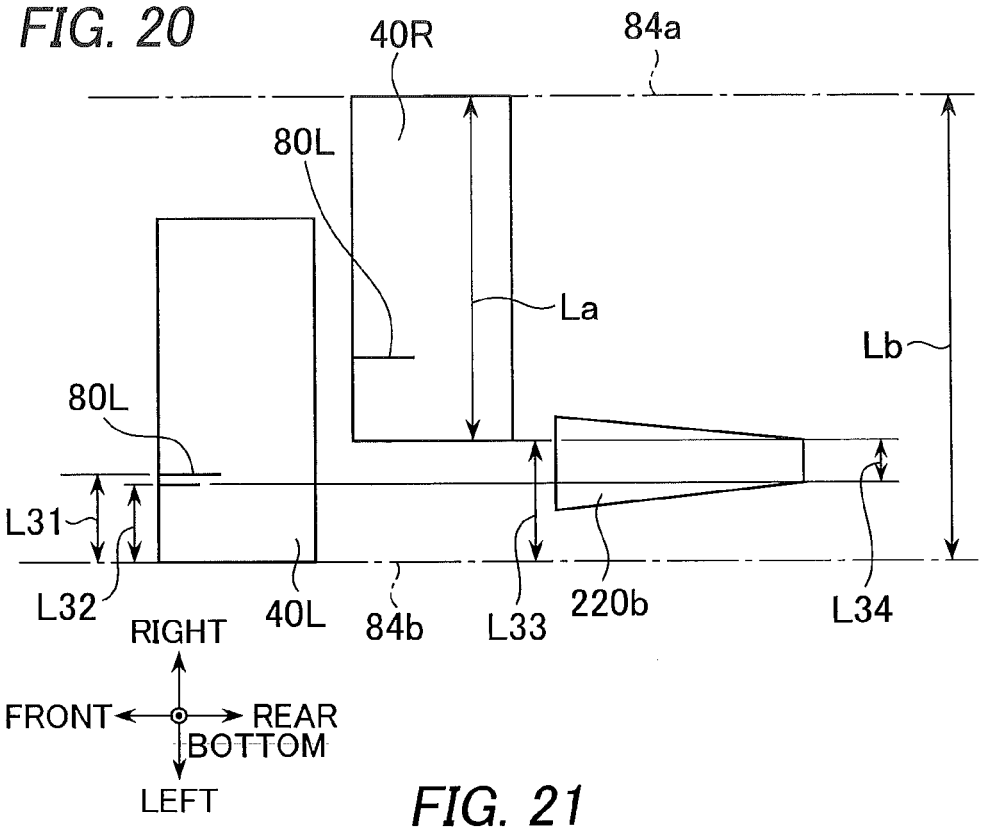

The above description has referred to the relationship in position and width between the scraper 220*a* and the bill 40 with the notch 80 cut apart from the right edge of the bill by one fourth of the bill width. However, as shown in FIG. 20, the relationship between the scraper 220*b* and the bill 40 with the notch 80L cut apart from the left edge of the bill 40 by one fourth of the bill width can be set with the above-described relationship reversed in terms of the lateral direction.

Specifically, the distance from the left transport limit line 84*b* to the position of the assumptive notch 80L of the bill 40L is indicated as a distance L31. The distance from the line 84*b* to the left edge of the scraper 220*b* is indicated as a distance L32. The distance from the line 84*b* to the left edge of the bill 40R is indicated as a distance L33. The scraper width of the part minimum in width of the scraper 220*b* is indicated as a length L34. Thence, it is preferable to render Expressions 8 to 11 to be satisfied when the above-described distances L21, L22 and L23 and the length L24 are substituted by the distances L31, L32 and L33 and the length L34, respectively.

It is apparent that the invention is not restricted to the case where the position and width of the scrapers 220 are set on the assumption that the notch is cut inward away from the edge of the bill in the direction of its longer edge by one fourth of the bill width but applicable to various cases. The medium processor and the medium storage and advancing apparatus may be arbitrarily structured such as to take into consideration a position where a notch is highly likely to appear depending on the kinds of media to be handled by medium processors such as automated teller machines.

In the temporary storage 212 with the above structure, when the bill 40 is pulled out, the outer peripheries of the upper reels 60*a* and 60*b* rotatably arranged to function as the one-side reels are, respectively, carrying windingly thereabout the upper tapes 62*a* and 62*b* functioning as the one-side tapes in abutment with the one surface, i.e. upper surface, of the bill 40.

In that operation, the bill 40 is peeled by the scrapers 220*a* and 220*b* from the upper tapes 62*a* and 62*b*, respectively, wound around the drum 36 to pass above the space SP. Furthermore, the bill 40 is guided by the transport guide 38 and then pulled out through the bill transaction slot 42 to the outside of the temporary storage 212.

At this time, in the temporary storage 212, the bill 40 is supported from below near its right edge by the scraper 220*a* and near its left edge by the scraper 220*b*.

Thus, if the bill 40 in the temporary storage 212 has the notch 80 cut between the right edge of the part minimum in width of the scraper 220*a* and the left edge of the part minimum in width of the scraper 220*b*, it can be supported on the left and right sides of the notch 80 from below.

In the temporary storage 212 thus structured, the bill 40 can be conveyed in the vicinity of the space SP, while preventing the bill 40 from warping from the notch in the downward direction, to the transport guide 38, thus being pulled out to the outside of the temporary storage 212. In this way, the temporary storage 212 can prevent the bill 40 from colliding with the transport guide 38.

In the temporary storage 212, due to an irregularity in thickness of bills 40 accommodated on the drum 36, the apparent outer diameter of the entirety including drum 36 may sometimes different between a portion of the drum 36 on which the upper tape 62*a* is wound and a portion of the drum 36 on which the upper tape 62*b* is wound.

However, in the embodiment, the scraper 220*a* and the scraper 220*b* are adapted to be rotatable independently of each other in the opposite directions by respective predetermined angles. Thus, even when the apparent outer diameter of the drum 36 may be different portion by portion of the periphery of the drum 36, the scrapers 220*a* and 220*b* can constantly follow and abut against the outer periphery of the upper tapes 62*a* and 62*b* wound around the drum 36 to thereby peel the bills off the drum 36.

The scrapers 220*a* and 220*b* do not necessarily rotate independently of each other. For example, the scrapers 220*a* and 220*b* may have the forward portion thereof integrated together.

The following will refer to the structure of the automated teller machine 10 and the temporary storage 212 in accordance with the embodiment, when adapted for processing a bill 140 with the thread 142.

In the temporary storage 212 of the embodiment, the width and position of the scrapers are set such that the bill 140 is held by the scrapers 220 at both left and right sides of the boundaries between the thread 142 and the paper part 144 which tends to be torn and that, even when the bill 140 deviates in the lateral direction, the bill 140 can be constantly held by the two scrapers 220.

Figure 21:
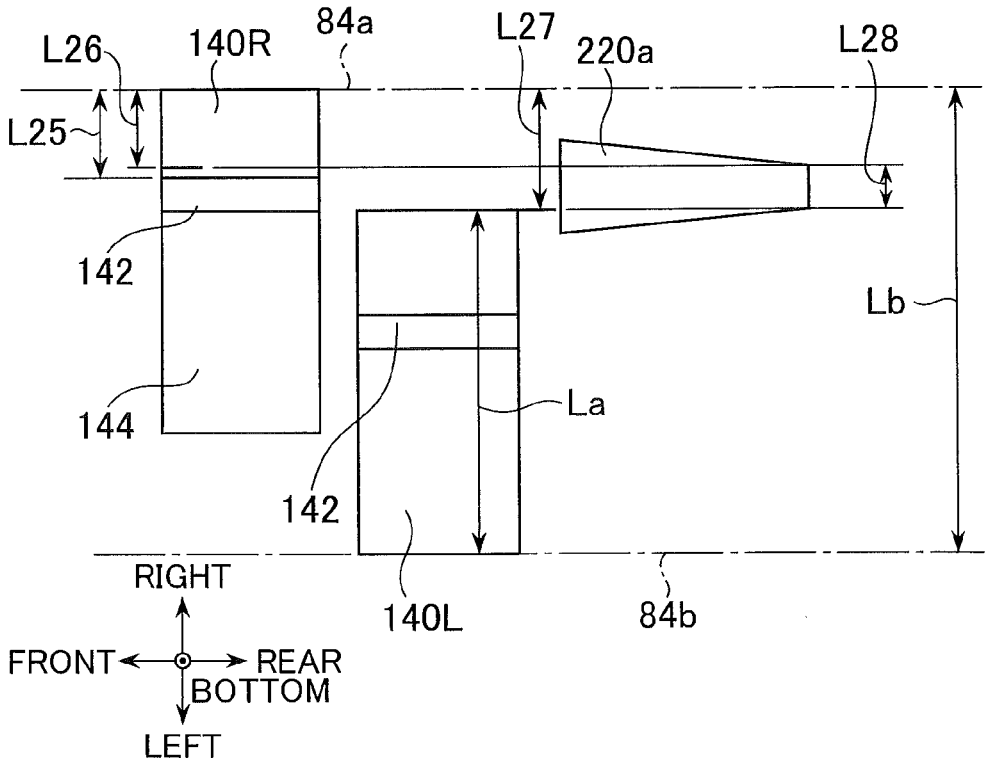

More specific conditions on setting the width and position of the scrapers 220 for the thread 142 will be described below. As shown in FIG. 21, the distance from the right transport limit line 84*a* to the right edge of the thread 142 of the bill 140R is indicated as a distance L25. The distance from the line 84*a* to the right edge of the part minimum in width of the scraper 220*a* is indicated as a distance L26. The distance from the line 84*a* to the right edge of the bill 140L is indicated as a distance L27. When the scraper width of the scraper 220*a* is further indicated as a length L28, the temporary storage 212 is constituted so as to satisfy following Expression 12. In FIG. 21, the scraper 220*b* is omitted from illustration.

$$L26<L25 \quad \text{(Expression 12)}$$

Note that the thread 142 has its left edge positioned nearer the bill center than its right edge. When the outside of the right edge of the thread 142 can be held by the scraper 220*a*, the outside of the left edge of the thread 142 can be surely held. Thus, the left edge of the thread can be excluded from consideration on the conditions of setting the scrapers.

Expression 12 defines the condition in which the right edge of the part minimum in width of the scraper 220*a* is located rightward from the right edge of the thread 142 of the bill 140R. Thus, the temporary storage 212 can hold the bill 140R at the right edge of the thread 142 by the scraper 220*a* even while the bill 140 deviates most rightward.

The temporary storage 212 is configured to satisfy following Expression 13.

$$L26 > L27 - L28 \quad \text{(Expression 13)}$$

Expression 13 defines the condition in which the left edge of the part minimum in width of the scraper 220*a* is located leftward from the right edge of the bill 140L. Thus, the temporary storage 212 can hold the bill 140L by the scraper 220*a* even while the bill 140 deviates most leftward.

The combination of Expressions 12 and 13 leads to following Expression 14.

$$L27 - L28 < L26 < L25 \quad \text{(Expression 14)}$$

In the temporary storage 212, the position and width of the scraper 220*a* are set so that the positions of the bill 140 and the thread 142 satisfy Expression 14.

Generally, the automated teller machine 10 handles various sizes of bills. Among such bills, even for bills having the bill width La shortest, it is preferable that the temporary storage 212 is configured to satisfy Expression 14.

Depending on the kinds of bills, threads may be variously positioned in the direction of the longer side thereof. Among a variety of bills the temporary storage 212 handles, it is preferable to adapt the temporary storage so as to satisfy Expression 14 for any bills having a thread provided even most outward.

Figure 22:
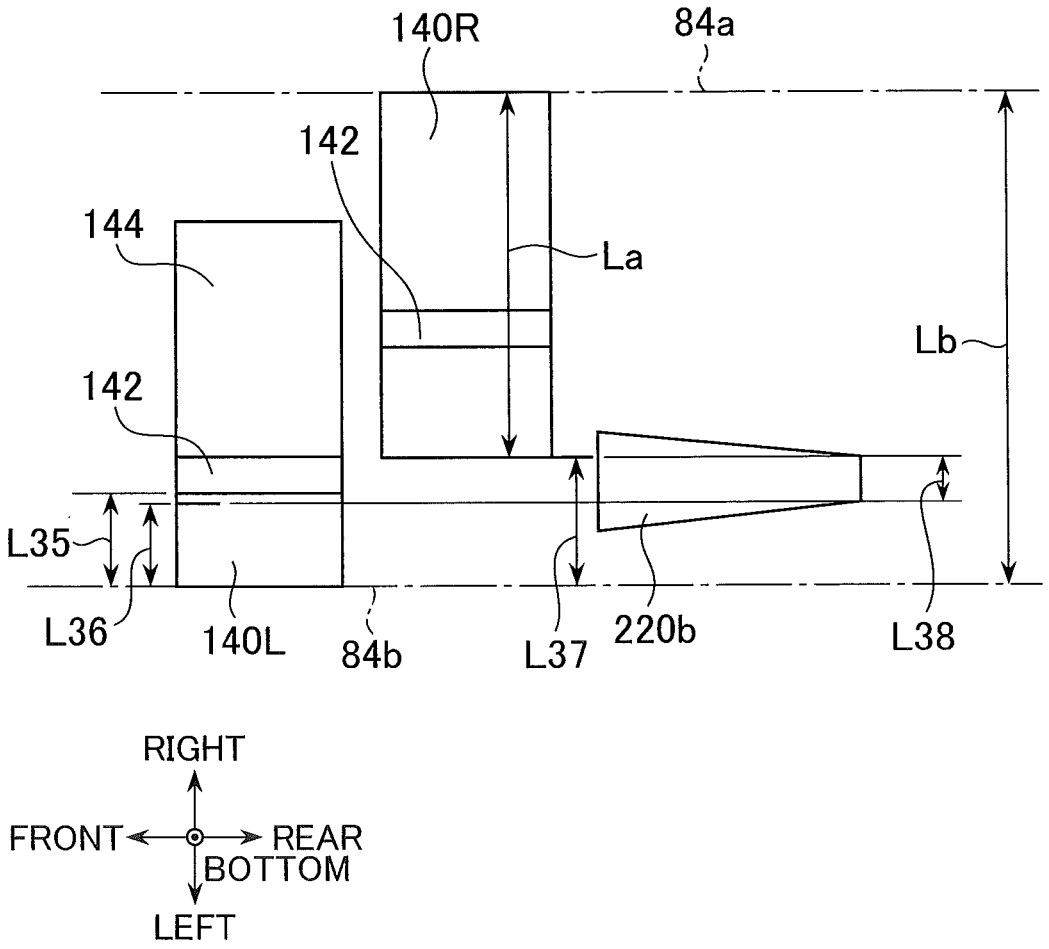

The above description has referred to the thread 142 provided near the right edge of the bill 140. On the contrary, as shown in FIG. 22, when the thread 142 is provided near the left edge of the bill 140, the position and width of the scraper 220*b* may be configured with the orientation in the above description reversed between left and right.

More specifically, the distance from the left transport limit line 84*b* to the left edge of the thread 142 of the bill 140L is indicated as a distance L35. The distance from the line 84*b* to the left edge of the minimum width part of the scraper 220*b* is indicated as a distance L36. The distance from the line 84*b* to the left edge of the bill 140R is indicated as a distance L37. The scraper width of the scraper 220*b* is indicated as a length L38.

The temporary storage 212 may be constituted so as to satisfy Expressions 12 to 14 of which the above distances L25, L26 and L27 and the length L28 are substituted by the distances L35, L36 and L37 and the length L38, respectively.

With the temporary storage 212 thus structured according to the one embodiment of the invention, the bill 140 with the thread 142 can constantly be held by the two, left and right, scrapers 220. In particular, the temporary storage 212 is adapted to support the bill 140 by the two, left and right, scrapers 220 at the opposite sides of the boundaries between the paper part 144 and the thread 142 provided therein, the boundary being likely to be torn. Thus, the bill can be transferred without partially warping.

Figure 23:
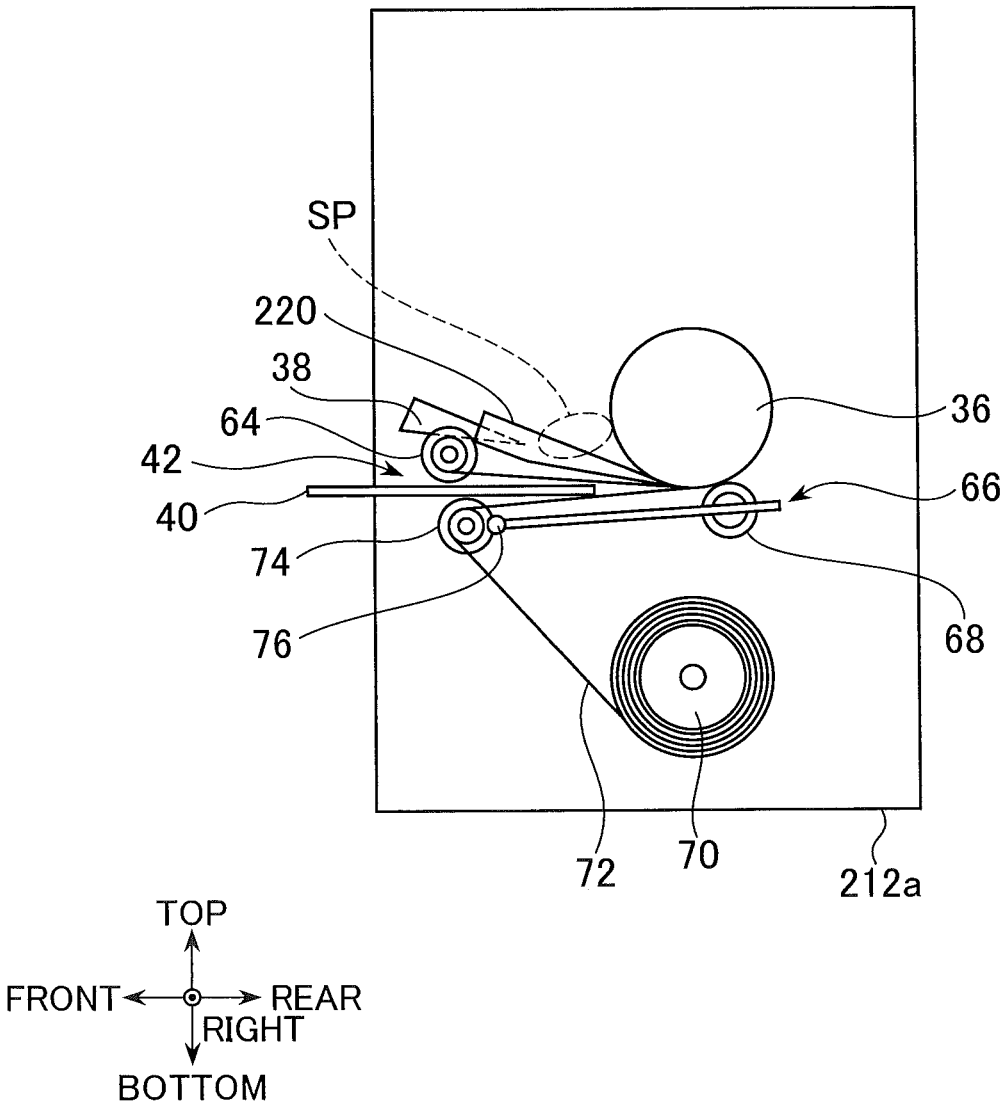
FIG. 23 is an ideational side view schematically showing the structure of a modified embodiment of the medium storage and advancing apparatus shown in FIG. 16.
Figure 24:
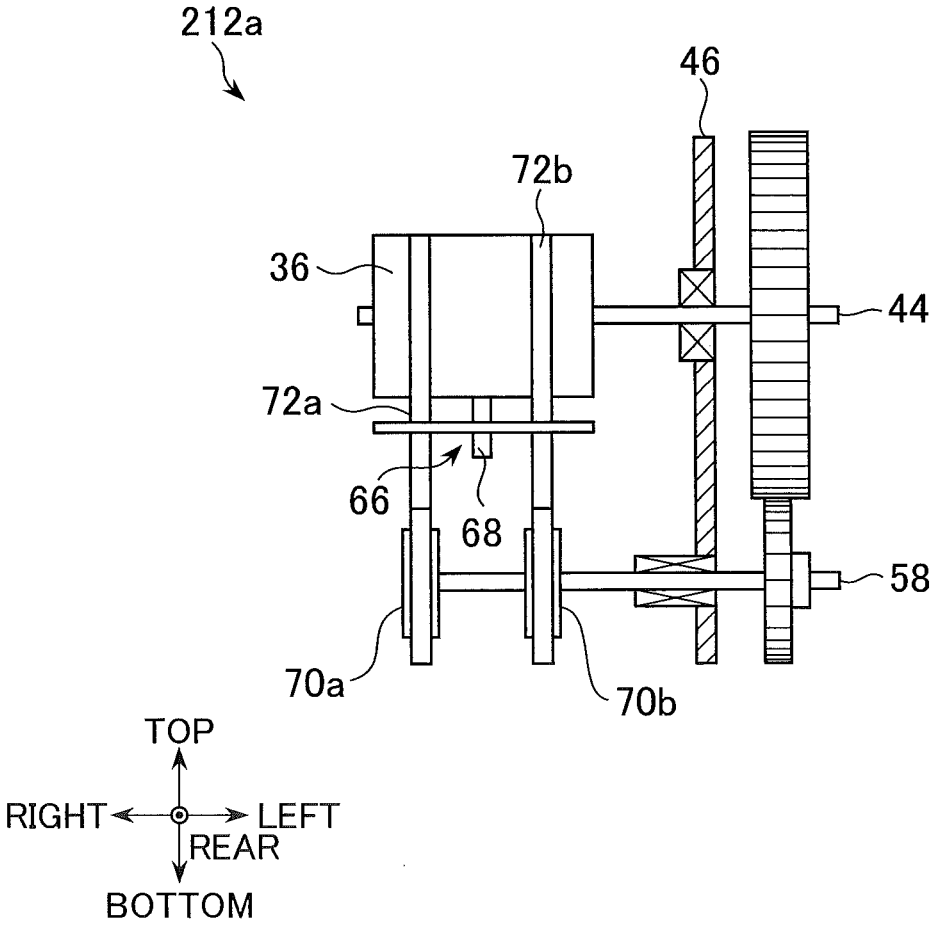
FIG. 24 is a partially cross-sectional back view of the substantial part of the modified embodiment shown in FIG. 23, together with a driving mechanism included therein.

Well, as shown in FIG. 16, the above description has referred to the temporary storage 212 in which the movable guide 66 is disposed above the traveled bill 40 and in which the transport guide 38 and the scrapers 220 are disposed below the bill. However, the present invention is not restricted thereto. As with the temporary storage 212*a* shown in FIGS. 23 and 24, the movable guide 66 may be disposed under the bill 40, and the transport guide 38 and the scrapers 220 may be provided above the bill 40.

The temporary storage 212*a* with the above structure is adapted to support the bill 40 at its lower surface by the movable guide 66, which can prevent the tip of the bill 40 in the transfer direction from hanging down even when the bill 40 is torn. The temporary storage 212*a* in the embodiment has the two scrapers 220 holding both left and right edges of the upper surface of the bill 40, and thus the bill 40 can be suppressed from warping upward due to the momentum generated upon pulling out the bill 40. Hence, the temporary storage 212*a* can prevent the bill 40 from colliding with the transport guide 38 when passing the space SP.

As described with reference to FIG. 19, the instant embodiment is adapted to satisfy the condition in which the right edge of the minimum width part formed at the rear end of the scraper 220*a* is positioned rightward with respect to the notch 80R of the bill 40R. However, the medium storage and advancing apparatus may be structured under the condition where the right edge of the maximum width part formed at the front end of the scraper 220*a* is positioned rightward with respect to the notch 80 of the bill 40R. In that case, if the bill 40R has the notch 80R slightly rightward with respect to the right edge of the minimum width part of the scraper 220*a*, the bill 40 would partially hang down from the notch 80R. However, the scraper 220*a* having its width increased in the forward direction can support the bill 40 as much as the bill 40 advances forward.

The above embodiment satisfies the condition in which the left edge of the part minimum in width formed at the rear end of the scraper 220*a* is positioned leftward with respect to the right edge of the bill 40L. However, the medium storage and advancing apparatus may be structured under the condition where the left edge of the maximum width part formed at the front end of the scraper 220*a* is positioned leftward with respect to the right edge of the bill 40L. In that case, if the bill 40L has its right edge slightly leftward with respect to the left edge of the part minimum in width of the scraper 220*a*, the bill 40L might not be held by the scraper 220*a*. However, the scraper 220*a* having its width increased in the forward direction can support the bill 40 as much as the bill 40 is transferred forward.

Subsequently, referring to FIGS. 25 to 27, the structure of a temporary storage 312 in accordance with a further alternative embodiment of the medium storage and advancing apparatus of the invention will be described in detail below. The components similar to those of the temporary storages 12 and 212 are indicated by the same reference numerals. To avoid redundant description, the similar components will not repeatedly be described in detail. The structure of the automated teller machine 10 with the temporary storage 312 is similar to that of the previous embodiments except for including the temporary storage 312 instead of the temporary storage 12 or 212. Therefore, the detailed description thereof will be avoided.

Differences in structure of the temporary storage 312 in this embodiment from the temporary storage 12 can be more clearly understood when viewing the temporary storage 312 from its rear or lower surface. The structure of the present embodiment will therefore be described with reference to FIG. 25 which shows the temporary storage 312 from its rear surface and FIGS. 26 and 27 which are views observed from the lower area of the space SP provided between the drum 36 and the transport guide 38.

Figure 25:
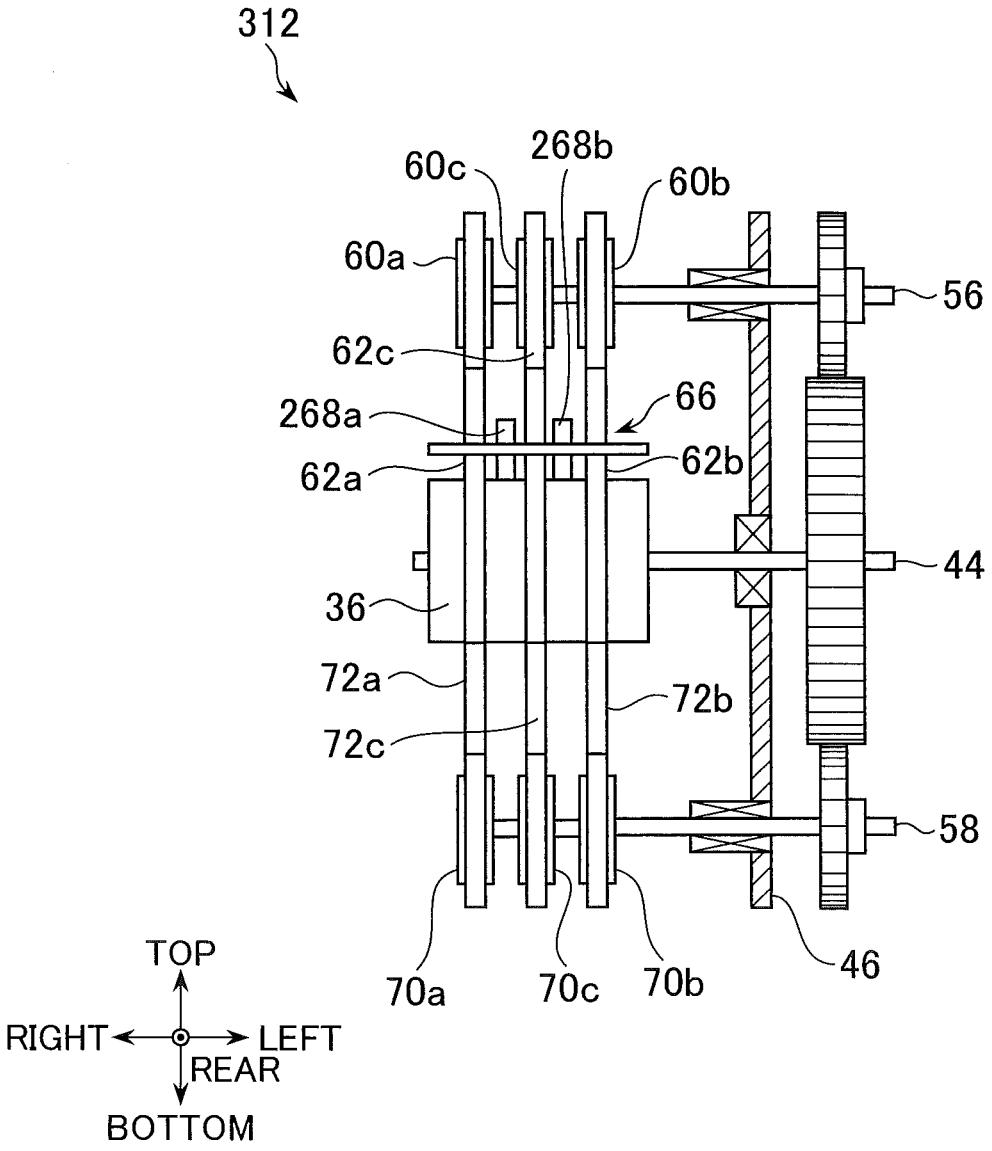
FIG. 25 is a partially cross-sectional back view, like FIG. 4, schematically showing the substantial part of further alternative embodiment of the medium storage and advancing apparatus according to the present invention.

The temporary storage 312 includes an upper reel 60*c* which is disposed between the upper reels 60*a* and 60*b* and which rotates about the reel shaft 56 as shown in FIG. 25. At the intermediate position between the upper tapes 62*a* and 62*b*, an upper tape 62*c* is provided which has its one end fixed to the upper reel 60*c* and which has the same tape width as the upper tapes 62*a* and 62*b*. Although in the embodiment all the upper tapes 62 have the same width, the upper tape 62*c* does not necessarily have the same width as the other upper tapes.

The upper tape 62*c* has its other end fixed to the middle part on the outer peripheral surface of the drum 36. Depending upon the rotational direction of the drum 36 and upper reel 60*c*, the upper tape 62*c* is wound around the drum 36 or rewound by the upper reel 60*c*.

The temporary storage 312 further includes a lower reel 70*c* which is disposed in the intermediate position between the lower reels 70*a* and 70*b* and which rotates about the reel shaft 58. At the intermediate position between the lower tapes 72*a* and 72*b*, that is to say, in the position opposite to the upper tape 62*c* with respect to the bill 40, a lower tape 72*c* is provided. The lower tape 72*c* has its one end fixed to the lower reel 70*c* and the same tape width as the upper tapes 72*a* and 72*b*. The lower tape 72*c* has the other end fixed to the middle part on the outer peripheral surface of the drum 36. Dependent on the rotational direction of the drum 36 and upper reel 70*c*, the lower tape 72*c* is wound around the drum 36 or rewound by the lower reel 70*c*.

In the present embodiment, two driven rollers 268*a* and 268*b* are attached to the vicinity of the rear part of the movable guide 66. The driven rollers 268*a* and 268*b* rotate together following the rotation of the drum 36 to abut against the surface of the bills 40 wound around the drum 36. In this embodiment, the driven roller 268*a* is disposed to abut against the surface of the bill 40 slightly rightward with respect to its center. On the contrary, the driven roller 268*b* is disposed to abut against the surface of the bill 40 slightly leftward with respect to the center.

As described earlier, bills 40 may often be folded at two or four positions in the direction of the longer edge thereof, so that the bills 40 may sometimes be torn at the two or more positions, such as positions inward from the respective edges in the longitudinal direction of the bills 40 by one fourth of the longitudinal length of the bills and a central position of the bills in the longitudinal direction. In the description below, a notch, which is formed at the position inward from an edge of a bill 40 in its longitudinal direction by one fourth of the longitudinal length, is indicated as a notch 80*a*, and a notch formed in the central portion of a bill in the longitudinal direction is indicated as a notch 80*b*.

First, the following description will be referred to the temporary storage 12 which includes two lower tapes 72*a* and 72*b* shown in FIGS. 3 and 4 and handles a bill with two notches. Depending on where the lower tapes 72*a* and 72*b* are arranged, the two notches 80*a* and 80*b* of the bill 40 can both be located, during transfer, between the lower tapes 72*a* and 72*b*. In that case, none of the lower tapes 72*a* and 72*b* could support the bill 40 at the portion between the notches 80*a* and 80*b*. As a result, the part between the notches 80*a* and 80*b* of the bill 40 would possibly hang down during transfer.

Figure 26:
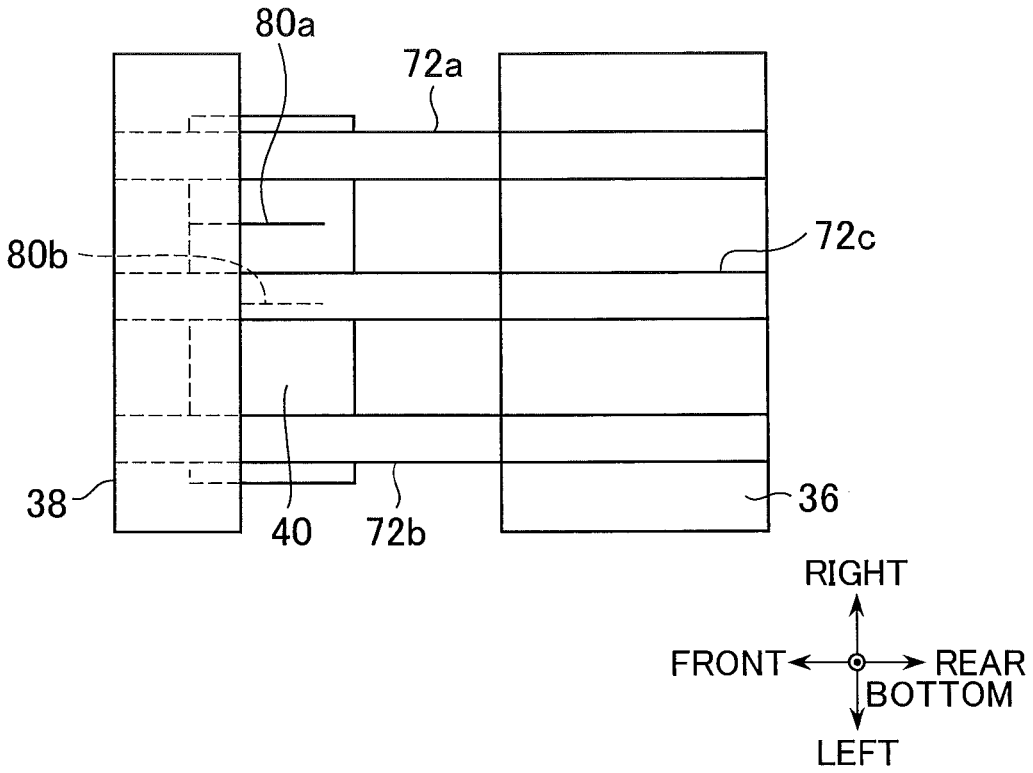
FIGS. 26 and 27 are bottom views of the substantial part of the embodiment shown in FIG. 25.

On the contrary, as shown in FIGS. 25 and 26, the temporary storage 312 in the instant embodiment is configured to include the upper tape 62*c* positioned in the middle portion between the upper tapes 62*a* and 62*b* and the lower tape 72*c* positioned as a further retainer in the middle portion between the lower tapes 72*a* and 72*b*. Thus, in the temporary storage 312, the pair of tapes 62*c* and 72*c* can supports a part including the notch 80*b*.

Figure 27:
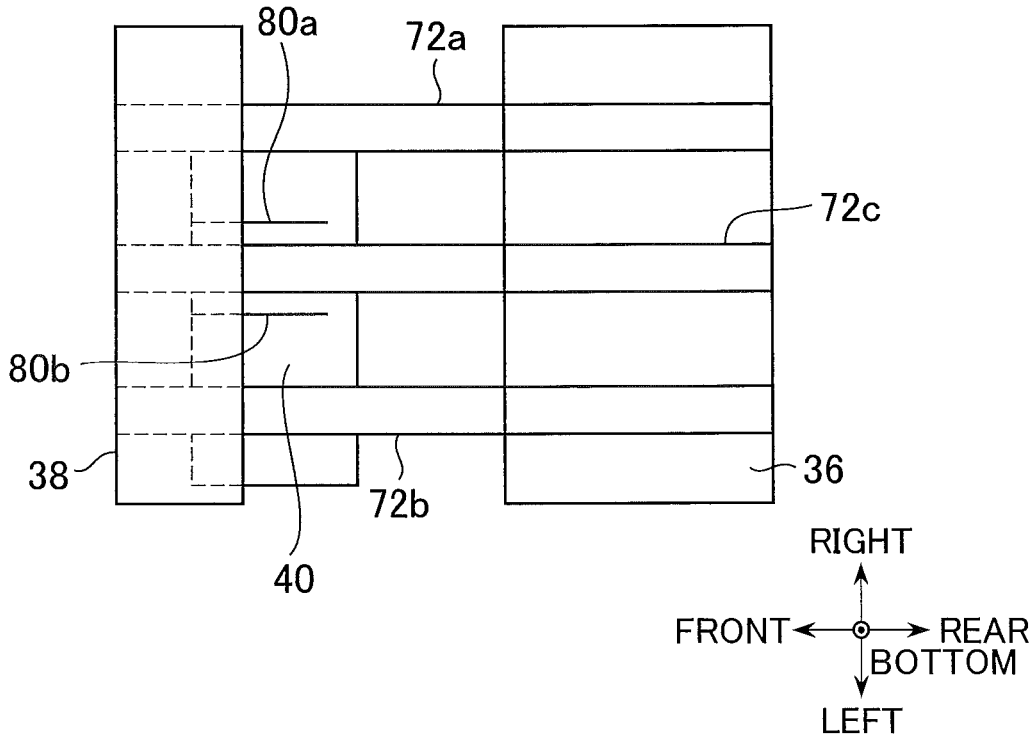

As shown in FIG. 27, for example, even when the bill 40 deviates leftward in the temporary storage 312, the lower tapes 72*a* and 72*c* can support both right and left sides of the notch 80*a*, respectively. Further, the lower tapes 72*c* and 72*b* of the temporary storage 312 can support both right and left sides of the notch 80*b*, respectively.

With the temporary storage 312 thus arranged, the bill 40 can be supported at both right and left sides of the respective notches 80*a* and 80*b* by means of the pair of adjacent tapes, thereby being prevented from hanging down from the notch.

The temporary storage 312 thus having three or more pairs of tapes can prevent the bill 40 from handing down from the notch unless the bill 40 has two or more notches cut between the adjacent tapes.

Although the above description has referred to the embodiment of the medium storage and advancing apparatus including two or three pairs of tapes arranged in parallel in the lateral direction, the present invention is not restricted thereto but four or more pairs of tapes may be arranged in parallel in the lateral direction. As more tapes are arranged, the adjacent tapes become closer to each other, which can reduce the possibility of two or more notches existing between the tapes.

The previous embodiments are described in which the scrapers 220 may be used as the retainers instead of the lower tapes 72 in the medium storage and advancing apparatus. In common with the allowance of three or more lower tapes 72 to be provided, three or more scrapers 220 may be arranged opposed to the three or more upper tapes 62.

When the three or more lower tapes or scrapers are used as the retainers, it is preferable that the outmost ones, in the lateral direction, of those retainers satisfy the conditions for setting the width and position of the above retainer.

In the above embodiments, the automated teller machine and the temporary storage are adapted to transfer bills 40 in the direction parallel to the short-edge thereof. However, the present invention can be applied to the case where the bill 40 is transferred in the direction parallel to the longer edge thereof. In that case, for example, when bills are assumed to be folded at two positions in the shorter-edge direction, the position and width of the tapes and the scrapers may be set so as to deal with a notch cut in the central portion of bills in the shorter-edge direction. When bills threaded are conveyed in the direction parallel to the longer edge, the positions and widths of the tapes and scrapers may be set in comply with a boundary between a paper part and the thread that weaves straight in bills in the direction of the longer edge from one end to the other end of the shorter edge of bills.

The above embodiments are applied to a temporary storage installed in the automated teller machine for handling cash to store and develop bills. The invention, however, is not restricted to the temporary storage but may be applied to a device such as the cash cartridge 30. That is, the invention can be applied to any medium storage and advancing apparatus which stores and advances a sheet- or strip-like medium by winding and rewinding the tapes between the drum and the reels.

The above description has referred to some embodiments of the temporary storage as the medium storage and advancing apparatus which is configured to use the upper reels 60 as one-side reels, the upper tapes 62 as one-side tapes and the drum 36 as a drum, and further selectively employing as a retainer either one of the scrapers 220 or an assembly including the lower reels 70 and the lower tapes 72. However, the invention is not restricted to those described embodiments. The respective components in the medium storage and advancing apparatus may be arbitrarily structured without losing their inherent functions.

The above description has referred to some embodiments of the automated teller machine 10 as the medium processor, which is configured to use the transport path 32 as a medium transport path, the bill transaction slot 42 as a medium gateway, the upper reels 60 as one-side reels, the upper tapes 62 as one-side tapes and the drum 36 as a drum, and further selectively employing as a retainer either one of the scrapers 220 or the assembly including the lower reels 70 and the lower tapes 72. However, the invention is not restricted to those described embodiments. The respective components in the medium storage and advancing apparatus may be arbitrarily structured without losing their inherent functions.

The above representation has referred to the automated teller machine as one embodiment of the medium processor according to the invention. However, as described so far, the present invention is not restricted to the automated teller machine but can be naturally applied to various devices which store and advance leaf- or strip-like media transferred medium.

The entire disclosure of Japanese patent application No. 2011-162419 filed on Jul. 25, 2011, including the specification, claims, accompanying drawings and abstract of the disclosure is incorporated herein by reference in its entirety.

While the present invention has been described with reference to the particular embodiments, it is not to be restricted by these embodiments. It is to be appreciated that those skilled in the art can change or modify the embodiments without departing from the scope and spirit of the present invention.

The invention claimed is:

1. A medium storage and advancing apparatus comprising:

a plurality of one-side reels rotatably arranged;

a plurality of one-side tapes respectively wound around said plurality of one-side reels;

a drum rotatably arranged to rotate in one direction to wind and store a medium with the medium being laid over said plurality of one-side tapes and in an opposite direction to pull out the wound medium; and a plurality of retainers respectively opposed to said plurality of one-side tapes with respect to the medium wound by said drum or pulled out from said drum, said retainers abutting against a surface of the medium to hold the medium;

wherein said plurality of one-side tapes have a tape width that is shorter than a width of the medium corresponding to a length of the medium in a direction perpendicular to a transfer direction of the medium, said plurality of one-side tapes being arranged in parallel and spaced with a spacing that is shorter than the width of the medium in a direction of the width of the medium to abut against another surface of the medium;

wherein said plurality of one-side reels include a first and a second one-side reel, said plurality of one-side tapes including a first one-side tape wound around said first one-side reel and a second one-side tape wound around said second one-side reel, and said plurality of retainers including a first retainer arranged opposed to said first one-side tape and a second retainer arranged opposed to said second one-side tape; and wherein said first retainer includes a first other-side reel rotatably arranged and a first other-side tape, said first other-side tape being wound around said first other-side reel and having a tape width that is shorter than the width of the medium, said first other-side tape being opposed to said first one-side tape with respect to the medium to abut against the surface of the medium, said second retainer including a second other-side reel rotatably arranged and a second other-side tape, and said second other-side tape being wound around said second other-side reel and having a tape width that is shorter than the width of the medium, said second other-side tape being opposed to said second one-side tape with respect to the medium to abut against the one surface of the medium.

2. The medium storage and advancing apparatus according to claim 1, wherein said apparatus performs storing and advancing at least one kind of medium, a direction from said second other-side tape to said first other-side tape in the direction of the medium width being defined as a first direction, a direction opposite to the first direction being defined as a second direction, a line closest to the second direction giving passage to an end in the second direction of the medium during transferring the medium within said apparatus being defined as a second direction transport limit line, and when an end, in the second direction, of one of the at least one kind of medium that has a smallest width is positioned on the second direction transport limit line, an end, in the second direction, of the first other-side tape is positioned closer to the second direction than another end, in the first direction, of the kind of medium having the smallest width.

3. The medium storage and advancing apparatus according to claim 2, wherein a line closest to the first direction giving passage to an end in the first direction of the medium during transferring the medium within said apparatus is defined as a first direction transport limit line, and when the end in the first direction of the one medium having the smallest width among the at least one kind of medium is positioned on the first direction transport limit line, an end in the first direction of the first other-side tape is positioned closer to the first direction than a position of a notch assumed in the medium having the smallest width.

4. The medium storage and advancing apparatus according to claim 3, wherein the end in the first direction of said first other-side tape is positioned closer to the first direction than a position of the medium having the smallest width located apart in the second direction from the end in the first direction of the medium by one fourth of the medium width.

5. The medium storage and advancing apparatus according to claim 2, wherein said apparatus performs storing and advancing at least one kind of medium having a thread, a line closest to the first direction giving passage to an end in the first direction of the medium during transferring the medium within said apparatus is defined as a first direction transport limit line, and when the end in the first direction of one medium having a smallest length from the end in the first direction of the medium to an end in the first direction of the thread among the at least one kind of medium is positioned on the first direction transport limit line, an end in the first direction of said first other-side tape is located closer to the first direction than the end in the first direction of the thread in the medium having the smallest length.

6. A medium storage and advancing apparatus comprising:

a plurality of one-side reels rotatably arranged;

a plurality of one-side tapes respectively wound around said plurality of one-side reels;

a drum rotatably arranged to rotate in one direction to wind and store a medium with the medium being laid over said plurality of one-side tapes and in an opposite direction to pull out the wound medium; and a plurality of retainers respectively opposed to said plurality of one-side tapes with respect to the medium wound by said drum or pulled out from said drum, said retainers abutting against a surface of the medium to hold the medium;

wherein said plurality of one-side tapes have a tape width that is shorter than a width of the medium corresponding to a length of the medium in a direction perpendicular to a transfer direction of the medium, said plurality of one-side tapes being arranged in parallel and spaced with a spacing that is shorter than the width of the medium in a direction of the width of the medium to abut against another surface of the medium;

wherein said plurality of one-side reels include a first and a second one-side reel, said plurality of one-side tapes including a first one-side tape wound around said first one-side reel and a second one-side tape wound around said second one-side reel, and said plurality of retainers including a first retainer arranged opposed to said first one-side tape and a second retainer arranged opposed to said second one-side tape; and wherein said first retainer includes a first scraper arranged opposed to said first one-side tape, said first scraper following and abutting against an outer periphery of said first one-side tape wound around said drum to remove the medium from said drum, said second retainer including a second scraper arranged opposed to said second one-side tape, and said second scraper following and abutting against an outer periphery of said second one-side tape wound around said drum to remove the medium from said drum.

7. The medium storage and advancing apparatus according to claim 6, wherein said apparatus performs storing and advancing at least one kind of medium, a direction from said second scraper to said first scraper in the direction of the width of the medium being defined as a first direction, a direction opposite to the first direction being defined as a second direction, a line closest to a second direction giving passage to an end in the second direction of the medium during transferring the medium within said apparatus being defined as a second direction transport limit line, and when an end in the second direction of one medium having a smallest width among the at least one kind of medium is positioned on the second direction transport limit line, an end in the second direction of said first scraper is positioned closer to the second direction than an end in the first direction of the medium having the smallest width.

8. The medium storage and advancing apparatus according to claim 7, wherein a line closest to the first direction giving passage to an end in the first direction of the medium during transferring the medium within said apparatus is defined as a first direction transport limit line, and when the end in the first direction of the medium having the smallest width among the at least one kind of medium is positioned on the first direction transport limit line, an end in the first direction of said first scraper is positioned closer to the first direction than a position of a notch assumed at the medium having the smallest width.

9. The medium storage and advancing apparatus according to claim 8, wherein the end in the first direction of said first scraper is positioned closer to the first direction than a position of the medium having the smallest width located apart in the second direction from the end in the first direction of the medium by one fourth of the medium width.

10. The medium storage and advancing apparatus according to claim 7, wherein said apparatus performs storing and advancing at least one kind of medium having a thread, a line closest to the first direction giving passage to an end in the first direction of the medium during transferring the medium within said apparatus is defined as a first direction transport limit line, and when the end in the first direction of one medium having a smallest length from an end in the first direction of the medium to an end in the first direction of the thread among the at least one kind of medium is positioned on the first direction transport limit line, an end in the first direction of said first scraper is positioned closer to the first direction than the end in the first direction of the thread in the medium having the smallest length.

11. A medium processor comprising:

a medium transport path that transfers a medium;

a medium gateway that receives and advances the medium from and to said medium transport path;

a plurality of one-side reels rotatably arranged;

a plurality of one-side tapes respectively wound around said plurality of one-side reels;

a drum rotatably arranged to rotate in one direction to wind and store the medium with the medium being laid over said plurality of one-side tapes and in an opposite direction to pull out the wound medium; and a plurality of retainers respectively arranged opposed to said plurality of one-side tapes with respect to the medium wound by said drum or advanced from said drum, said retainers abutting against a surface of the medium to hold the medium;

wherein said plurality of one-side tapes have a tape width that is shorter than a width of the medium corresponding to a length of the medium in a direction perpendicular to a transfer direction of the medium, said plurality of one-side tapes being arranged in parallel and spaced with a spacing that is shorter than the width of the medium in a direction of the width of the medium to abut against another surface of the medium;

wherein said plurality of one-side reels include a first and a second one-side reel, said plurality of one-side tapes including a first one-side tape wound around said first one-side reel and a second one-side tape wound around said second one-side reel, said plurality of retainers including a first retainer arranged opposed to said first one-side tape and a second retainer arranged opposed to said second one-side tape; and wherein the first retainer includes a first other-side reel rotatably arranged and a first other-side tape, said first other-side tape being wound around said first other-side reel and having a tape width that is shorter than the width of the medium, said first other-side tape being opposed to said first one-side tape with respect to the medium to abut against the surface of the medium, said second retainer includes a second other-side reel rotatably arranged and a second other-side tape, and said second other-side tape being wound around said second other-side reel and having a tape width that is shorter than the width of the medium, said second other-side tape being opposed to said second one-side tape with respect to the medium to abut against the surface of the medium.

12. A medium processor comprising:

a medium transport path that transfers a medium;

a medium gateway that receives and advances the medium from and to said medium transport path;

a plurality of one-side reels rotatably arranged;

a plurality of one-side tapes respectively wound around said plurality of one-side reels;

a drum rotatably arranged to rotate in one direction to wind and store the medium with the medium being laid over said plurality of one-side tapes and in an opposite direction to pull out the wound medium; and a plurality of retainers respectively arranged opposed to said plurality of one-side tapes with respect to the medium wound by said drum or advanced from said drum, said retainers abutting against a surface of the medium to hold the medium;

wherein said plurality of one-side tapes have a tape width that is shorter than a width of the medium corresponding to a length of the medium in a direction perpendicular to a transfer direction of the medium, said plurality of one-side tapes being arranged in parallel and spaced with a spacing that is shorter than the width of the medium in a direction of the width of the medium to abut against another surface of the medium;

wherein said plurality of one-side reels include a first and a second one-side reel, said plurality of one-side tapes including a first one-side tape wound around said first one-side reel and a second one-side tape wound around said second one-side reel, said plurality of retainers including a first retainer arranged opposed to said first one-side tape and a second retainer arranged opposed to said second one-side tape; and wherein said first retainer includes a first scraper arranged opposed to said first one-side tape, said first scraper following and abutting against an outer periphery of said first one-side tape wound around said drum to remove the medium from said drum, said second retainer including a second scraper arranged opposed to said second one-side tape, said second scraper following and abutting against an outer periphery of said second one-side tape wound around said drum to remove the medium from said drum.

* * * * *